US005966952A

United States Patent [19]

Misawa et al.

[11] Patent Number: 5,966,952

[45] Date of Patent: Oct. 19, 1999

[54] HEAT PUMP SYSTEM WITH BALANCED TOTAL HEATING-EMITTING AND ABSORBING CAPACITIES AND METHOD FOR STABLE HEAT PUMPING OPERATION

[75] Inventors: Makoto Misawa; Yukiyoshi Takiguchi; Ryosuke Sugita, all of Shingai Iwata Shizuoka, Japan

[73] Assignee: Yamaha Hatsudoki Kabushiki Kaisha, Shizuoka-ken, Japan

[21] Appl. No.: 08/708,889

[22] Filed: Sep. 5, 1996

[51] Int. Cl.[6] ..... F25B 29/00; F25B 43/00

[52] U.S. Cl. ..... 62/159; 62/503; 62/DIG. 17

[58] Field of Search ..... 62/DIG. 17, 222, 62/503, 323.1, 79, 159; 165/63

[56] References Cited

U.S. PATENT DOCUMENTS 2,882,695 4/1959 Zwickl ..... 62/DIG. 17
4,785,639 11/1988 Biagini ..... 62/DIG. 17

FOREIGN PATENT DOCUMENTS 0252877 10/1989 Japan ..... 62/DIG. 17

OTHER PUBLICATIONS

Process Instruments and Controls Handbook, Considine 1957, TA 165,C65, pp. 11–2/ ,11–6 ,11–7.

*Primary Examiner*—William Wayner
*Attorney, Agent, or Firm*—Knobbe, Martens, Olson & Bear, LLP

[57] ABSTRACT

A heat pump system usable as an air-conditioning apparatus, a refrigerant apparatus, or a temperature-conditioning apparatus, having a heat capacity detection mechanism for detecting a signal indicative of a ratio of or a difference between the total heat-emitting capacity of the condenser and the total heat-absorbing capacity of the evaporator, and an energy-supplying mechanism for exerting energy onto the refrigerant, thereby compensating for insufficient total hear-absorbing capacity, especially in the cooling mode when condensation capacity increases due to, for example, a cold or wind environment.

7 Claims, 18 Drawing Sheets

F

HEAT PUMP SYSTEM WITH BALANCED TOTAL HEATING-EMITTING AND ABSORBING CAPACITIES AND METHOD FOR STABLE HEAT PUMPING OPERATION

BACKGROUND

1. Field of the Invention

This invention relates to a heat pump system usable as an air-conditioning apparatus, a refrigeration apparatus, or a temperature-conditioning apparatus, and in particular, to such an apparatus provided with an energy compensation system and/or a refrigerant flow control system which allow(s) for stable heat pumping operation by compensating for insufficient total heat-absorbing capacity, especially when condensation capacity increases due to, for example, a cold or windy environment. This invention also relates to a method for stable heat pumping operation.

2. Background of the Art

A heat pump system, which is used as an air-conditioning apparatus or a refrigeration apparatus, enables cooling the air in a room or a refrigerator by circulating refrigerant in a refrigerant circulation line through an outside heat-exchanger (condenser), an expansion valve, an inside heat-exchanger (evaporator), and an accumulator in sequence, with a compressor driven by an engine or an electric motor, for example.

In operating a heat pump system as an air-conditioning apparatus, for example, it is necessary in some cases to cool a room even when the outside is very cold or very windy because heat is internally generated in the room. When a heat pump system has an outside heat-exchanger with a heat exchange capacity sufficient for operating multiple inside heat-exchangers (evaporators), it is necessary in some cases to cool only some of the rooms, i.e., inside heat-exchangers.

In operating a heat pump system as a refrigeration apparatus, it is necessary in some cases to cool or freeze material in a storage compartment of a refrigerator such as a display case, which is placed in an air-conditioned (warm) room even when the outside is very cold or very windy. When a heat pump system has an outside heat-exchanger with a heat exchange capacity sufficient for operating an inside heat-exchanger (evaporator) with a high cooling capacity, it is necessary in some cases to operate the apparatus only with a low cooling capacity.

As understood from the above, when a heat pump system is used as an air-conditioning apparatus to cool the air in a room or as a refrigeration apparatus to cool the air in a storage compartment of a refrigeration apparatus, condensation capacity at an outside heat-exchanger (condenser) exceeds evaporation capacity at an inside heat-exchanger (evaporator) in some cases. When such cases occur, the pressure in a refrigerant circulation line upstream of an evaporation valve (i.e., on the high pressure side) decreases, the difference in pressure between upstream of and downstream of the evaporation valve, i.e., between the high pressure side and the low pressure side, is then reduced. As a result, the volume of a refrigerant passing through the evaporation valve is reduced, and then total heat-absorbing at the inside heat-exchanger (evaporator) is diminished, thereby lessening cooling capacity. Further, because the volume of refrigerant passing through the evaporation valve decreases, stable cooling and refrigeration operation suffers.

SUMMARY OF THE INVENTION

The present invention has exploited a heat pump system usable as an air-conditioning apparatus, a refrigeration apparatus, or a temperature-conditioning apparatus having stable cooling capacity without significant influence from the environment surrounding an outside heat-exchanger (i.e., a condenser when used as a air-conditioning apparatus or a refrigeration apparatus). An objective of the present invention is to provide a heat pump system which allows for stable heat pumping operation even when the outside is very cold or very windy, or when an inside heat-exchanger or evaporator having a relatively small capacity is only used as compared with an outside heat-exchanger, i.e., in low load operation.

Namely, one important aspect of the present invention is a heat pump system comprising a refrigerant circulation line in which a refrigerant circulates, said refrigerant circulation line comprising: a compressor for circulating said refrigerant; a condenser for exchanging heat between said refrigerant and the medium (such as air) outside said condenser; an expansion valve; and an evaporator for exchanging heat between said refrigerant and the medium (such as air) outside said evaporator, wherein said apparatus further comprises: a heat capacity detection mechanism for detecting a signal indicative of a ratio of or a difference between the total heat-emitting capacity of said condenser and the total heat-absorbing capacity of said evaporator; and an energy-supplying mechanism for exerting energy onto said refrigerant based on the signal. By using the heat capacity detection mechanism and the energy-supplying mechanism, it is possible to exert compensation energy onto the refrigerant according to the radiation and total heat-absorbing capacity which are detected when the outside is very cold or windy or when it is operated with low-cooling capacity, i.e., when the total heat-emitting capacity exceeds the total heat-absorbing capacity, thereby allowing for stable cooling operation.

In the above heat pump system, the energy is exerted by said energy-supplying mechanism normally based on a signal indicative of the difference between said total heat-emitting capacity and said total heat-absorbing capacity or the capacity ratio of said total heat-emitting capacity to said total heat-absorbing capacity. In particular, the energy is exerted preferably when the difference between said total heat-emitting capacity and said total heat-absorbing capacity or the capacity ratio of said total heat-emitting capacity to said total heat-absorbing capacity exceeds a given value.

In the aforesaid heat pump system, said energy-supplying mechanism is controlled to exert energy preferably in such a way that the higher the difference or the capacity ratio, the greater the energy exerted onto said refrigerant becomes. By the above control, heat pumping operation is further stabilized. Energy exertion is effective when energy is exerted onto the refrigerant in the refrigerant circulation line on the low pressure side. Various heaters such as electric heaters can be provided at appropriate positions so as to heat the refrigerant. When the compressor is driven by a water-cooled engine, heat from the water circulating through the engine can be used to exert energy onto the refrigerant downstream of said evaporator and upstream of said compressor. When the refrigerant circulation line further comprises an oil separator downstream of the compressor and upstream of the condenser, heat from the oil in the oil separator can be used to exert energy onto the refrigerant downstream of the evaporator and upstream of the compressor.

Another important aspect of the present invention is a heat pump system comprising a refrigerant circulation line in which a refrigerant circulates, said refrigerant circulation line comprising: a compressor for circulating said refrigerant; a condenser for exchanging heat between said refrigerant and the medium (such as air) outside said condenser; an expansion valve; and an evaporator for exchanging heat between said refrigerant and the medium (such as air) outside said evaporator, wherein said apparatus further comprises: a heat capacity detection mechanism for detecting a signal indicative of a ratio of or a difference between the total heat-emitting capacity of said condenser and the total heat-absorbing capacity of said evaporator; and a flow balance controlling mechanism for controlling the flow ratio of the amount of the refrigerant passing through said evaporator to that of the refrigerant passing through said condenser based on a signal indicative of a ratio of or a difference between the total heat-emitting and heat-absorbing capacities. By controlling the flow ratio according to the difference in pressure between the high pressure side and the low pressure side or the capacity ratio, it is possible to effectively balance the total heat-emitting capacity and the endothermic heat capacity.

In the above heat pump system, said flow balance controlling mechanism preferably comprises a bypass line bypassing said expansion valve and said evaporator and communicating the refrigerant circulation line downstream of said condenser and that downstream of said evaporator, thereby effectively balancing the total heat-emitting capacity and the total heat-absorbing capacity. Bypass lines other than the above can be adopted, such as a bypass line bypassing said compressor and said condenser and communicating the refrigerant circulation line downstream of said evaporator and that downstream of said condenser; a bypass line bypassing said condenser and communicating the refrigerant circulation line upstream and downstream of said condenser; and a bypass line bypassing said condenser and said expansion valve and communicating the refrigerant circulation line upstream of said condenser and downstream of said expansion valve. The flow ratio is normally controlled based on a signal indicative of the difference between said total heat-emitting capacity and said total heat-absorbing capacity or the capacity ratio of said total heat-emitting capacity to said endothermic heat capacity. In particular, the flow ratio is controlled preferably when the difference between said total heat-emitting capacity and said total heat-absorbing capacity or the capacity ratio of said total heat-emitting capacity to said total heat-absorbing capacity exceeds a given value.

In the aforesaid heat pump system, said flow balance controlling mechanism controls the flow ratio preferably in such a way that the higher the difference or the capacity ratio, the lower the flow ratio becomes.

Further, the flow balance controlling mechanism and the aforesaid energy-supplying mechanism can be used in combination of two or more for further improvement.

The present invention is adapted to be embodied in both a heat pump system and a heat pumping method. Further, the present invention is also adapted to be embodied in air-conditioning apparatuses for heating or cooling and refrigerators, which are either engine-driven or electric motor-driven. The medium whose temperature is controlled is normally air. However, media other than air, such as water, fermentation fluids, and other fluids, can be heated or cooled. In the above, the compressor, the condenser, the expansion valve, the evaporator, and the like are used as generic terms, and each can be composed of plural members, e.g., the compressor can be composed of plural compressors. Switching between the heating mode and the cooling mode can be conducted using a four-way valve for reversing the refrigerant flow, i.e., an inside heat-exchanger and an outside heat-exchanger function as the condenser and the evaporator, respectively, in the heating mode, and they perform the opposite functions in the cooling mode.

DETAILED DESCRIPTION OF THE PREFERRED EMBODIMENTS

Figure 1:
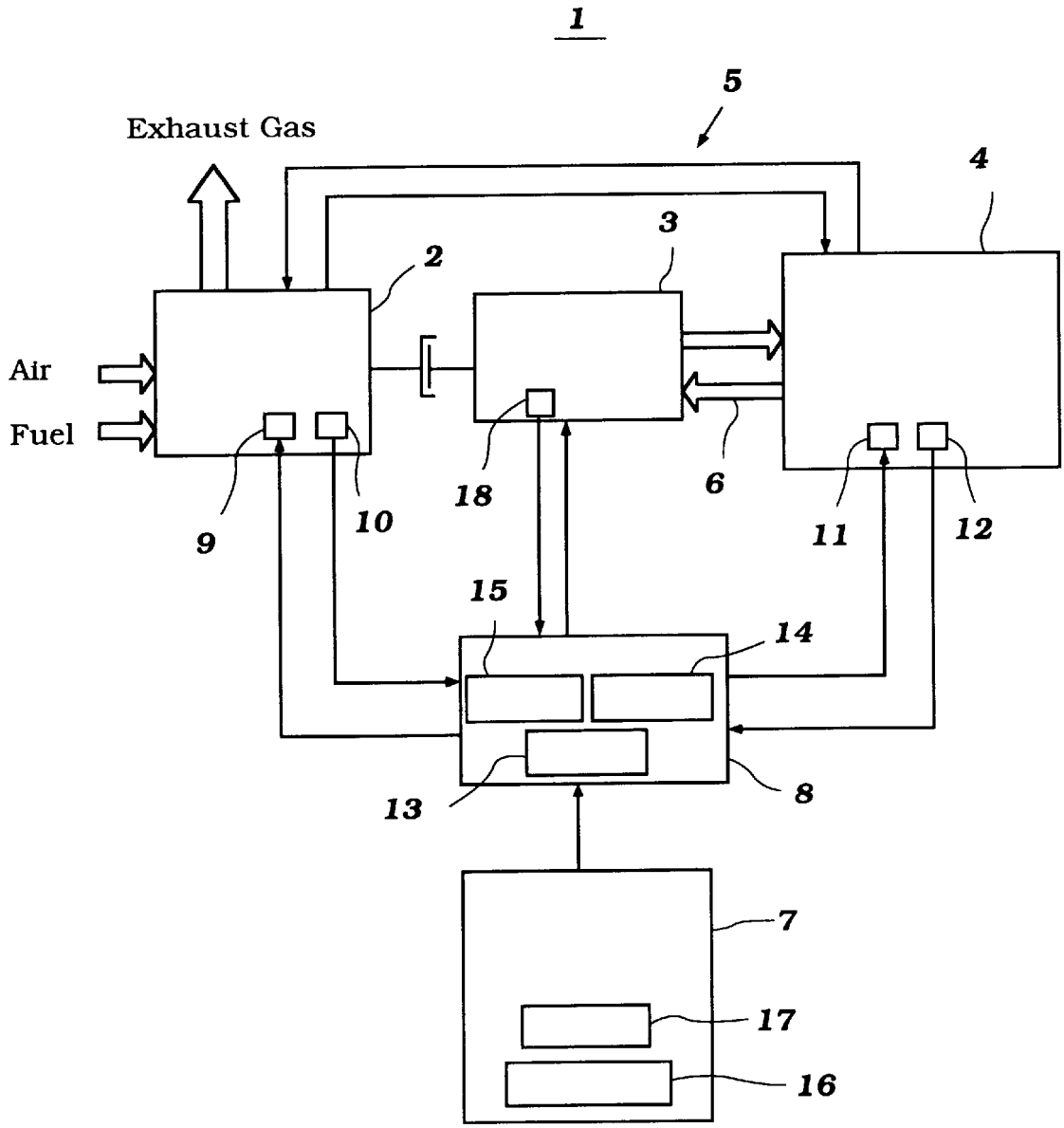
FIG. 1 is a schematic illustration showing basic structures of an engine-driven heat pump system used as an air-conditioning apparatus according to an embodiment of the present invention.

Referring now in detail to the drawings, an air-conditioning apparatus is shown. The invention is shown in conjunction with an engine-driven air-conditioning apparatus for heating or cooling, since the invention has particular utility in conjunction with an engine. However, the invention can be embodied in conjunction with a refrigerator, and with an electric motor-driven heat pump system. Those skilled in the art can readily understand how the invention can be utilized with any known type of heat pump systems.

In the present invention, an inside heat-exchanger is a heat-exchanger for exchanging heat between the refrigerant in a refrigerant circulation line of a heat pump system and the air inside a room of a building or inside a storage compartment (inner compartment) of a refrigerator. An outside heat-exchanger is, on the other hand, a heat-exchanger for exchanging heat between the refrigerant in the refrigerant circulation line of the heat pump system and the air outside the room of the building or outside the storage compartment (inner compartment) of the refrigerator; the outside heat-exchanger can be installed outside or inside the room (normally outside the room) in which the refrigerator is installed.

Energy Exerting Position

In the heat pump system of the present invention, in order to counter circumstances wherein the total heat-emitting capacity of the condenser surpasses the total heat-absorbing capacity of the evaporator, the energy-supplying mechanism may be provided on the refrigerant circulation line preferably on the high pressure side between the compressor and the expansion valve via the condenser, thereby offsetting excess total heat-emitting from the condenser using the supplied energy. As a result, reduction in pressure on the high pressure side can be prevented. In the above, when the heat pump system is adapted for an air-conditioning apparatus, the above operation takes place when in the cooling mode, wherein an outside heat-exchanger functions as a condenser.

Alternatively, in order to counter circumstances wherein the total heat-emitting capacity of the condenser surpasses the total heat-absorbing capacity of the evaporator, the energy-supplying mechanism may be provided on the refrigerant circulation line preferably on the low pressure side from the expansion valve to the condenser via the evaporator, thereby offsetting insufficient total heat-absorbing absorbed using the evaporator by the supplied energy to balance the total heat-emitting with the total heat-absorbing and the energy provided by the work of the compressor. As a result, even when the total heat-emitting is excessive, the amount of liquid refrigerant does not increase steeply, and therefore, reduction in pressure on the high pressure side can be prevented. In the above, when the heat pump system is adapted for an air-conditioning apparatus, the above operation takes place when in the cooling mode, wherein an outside heat-exchanger functions as a condenser.

When the energy-supplying mechanism is provided in an accumulator, which is provided downstream of the evaporator and upstream of the compressor, heat can efficiently be transferred to the liquid refrigerant, since liquid refrigerant has a higher heat-transfer efficiency than vapor refrigerant.

When the heat pump apparatus is an air-conditioning apparatus with a four-way valve, wherein the energy-supplying mechanism is provided on the refrigerant circulation line on the refrigerant intake side between the four-way valve and the compressor, it is possible to balance the total heat-emitting with the total heat-absorbing and the energy provided by the work of the compressor, even when the former tends to surpasses the latter. In this embodiment, such control can be conducted not only in the cooling mode but also in the heating mode.

When the heat pump apparatus has a water-cooled engine, a cooling water heat-exchanger for exchanging heat between the cooling water circulating therethrough, which has absorbed heat from the water-cooled engine, and the refrigerant circulating therethrough, can be used as an energy-supplying mechanism. In this embodiment, exhaust heat from the engine can efficiently be used.

Basic Control System

FIG. 1 is a schematic illustration showing basic structures of an engine-driven heat pump system used as an air conditioning apparatus according to an embodiment of the present invention.

An air-conditioning apparatus 1 functioning as a heat pump system comprises an engine unit 2 functioning as a driving power (an electric motor can be used instead), a compressor system unit 3, a heat pump unit 4, a hot water circulation line 5 in which cooling water from the engine unit 2 circulates between the engine unit 2 and the heat pump unit 4, and a refrigerant circulation line 6 in which pressurized refrigerant such as Freon circulates between the compressor system unit 3 and the heat pump unit 4. The engine unit 2, the compressor system unit 3, and the heat pump unit 4 are controlled by a control unit 8 according to signals from an operation unit 7.

The engine unit 2 is provided with an actuator unit 9 and a sensor unit 10, and information on engine performance from the sensor unit 10 is transmitted to the control unit 8 which then outputs signals to the actuator unit 9 controlling the engine unit 2. In the engine system, a mixed gas of air and fuel gas is introduced through an induction system, and ignition occurs, followed by discharging exhaust gas through an exhaust system.

The compressor system unit 3 is comprised of plural compressors, and the number of engaged compressors (compressors in operation) of the compressor system unit 3 is controlled by signals from the control unit 8, depending on the air-conditioning load. The compressor system unit 3 is provided with an engaged-compressor detection means 18, from which performance information on the compressors is transmitted to the control unit 8. The heat pump unit 4 is operated by operation of the compressor system unit 3 via the refrigerant circulation line 6.

The heat pump unit 4 is comprised of an actuator unit 11 and a sensor unit 12, and information on heat pump performance from the sensor unit 12 is transmitted to the control unit 8 which then outputs signals to the actuator unit 11 controlling heating or cooling operation.

The control unit 8 is provided with a control means 13, a memory means 14, and a drive means 15. The control means 13 controls the drive means 15 based on the instructions from the operation unit 7, the information stored in the memory means 14, the information on engine performance from the sensor unit 10, and the information on heat pump performance from the sensor unit 12. By the drive means 15, the actuator unit 9, the compressor system unit 3, and the actuator unit 11 of the heat pump unit 4 are driven.

The operation unit 7 is provided with a switch unit 16 and a display unit 17. When an operator manipulates the switch unit 16, signals are transmitted to the control unit 8 so as to engage the heat pump system 1, and operation performance is indicated on the display unit 17.

Hereinafter, first, structures of a heat pump system according to the present invention will be described with reference to the drawings, and then the functions and effects of particular structures related to the present invention will be explained.

Structures of Air-Conditioning Apparatus

Figure 2:
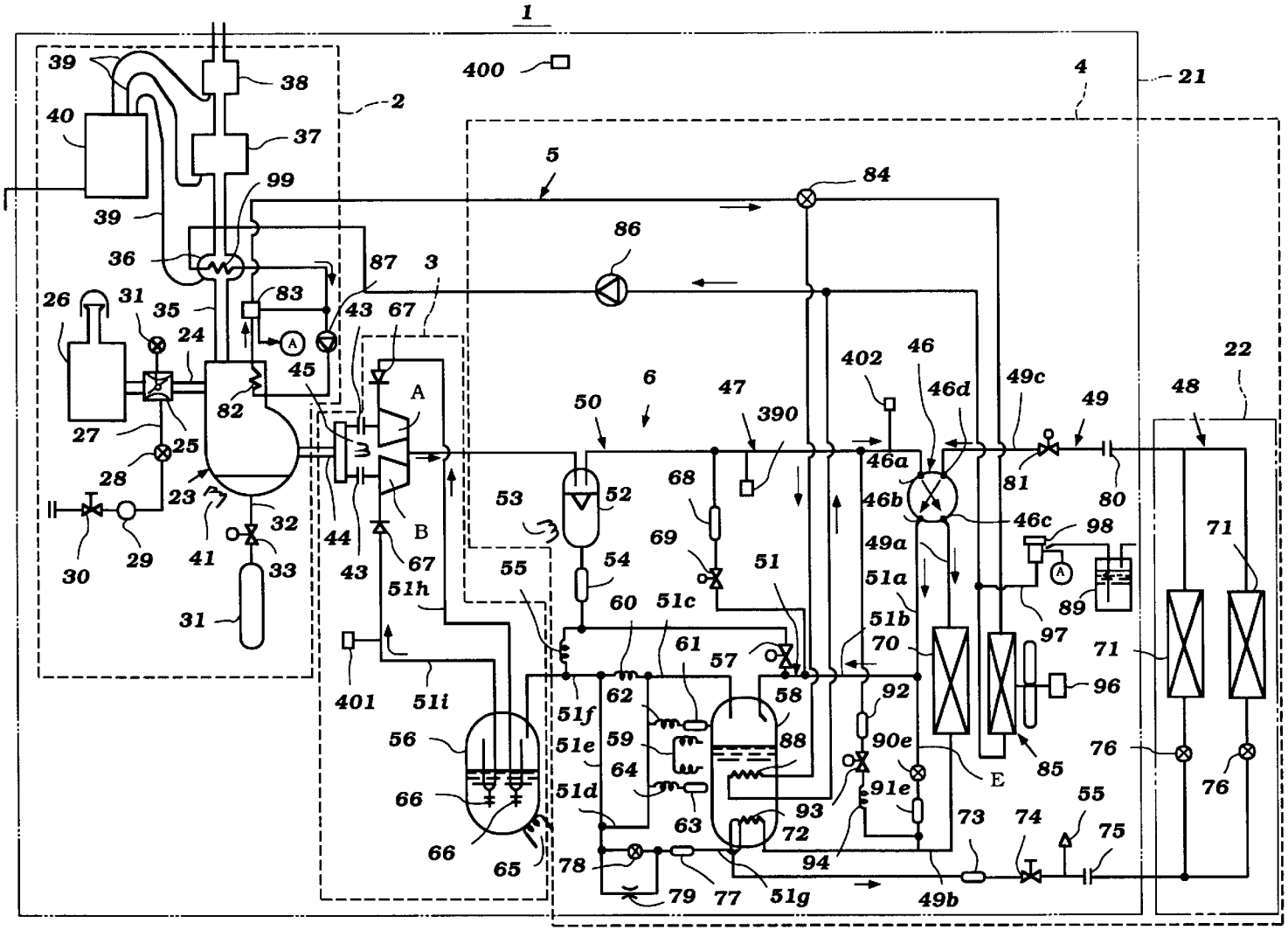
FIG. 2 is a schematic circuit illustrating structures of an engine-driven heat pump system used as an air-conditioning apparatus when in the cooling mode according to a first embodiment of the present invention.

Referring in detail to the drawings, and to a first embodiment shown in FIGS. 2–8 initially by reference to FIG. 2, an air-conditioning apparatus 1 (engine-driven) functioning as a heat pump system is shown.

The air-conditioning apparatus 1 comprises an outside unit 21 and an inside unit 22. An engine unit 2, a compressor unit 3, a hot water circulation line 5, and a refrigerant circulation line 6 are provided in the outside unit 21. A heat pump unit 4 is constituted by the inside unit 22 and a part of the outside unit 21.

The engine unit 2 includes a water-cooled engine 23, to which a mixer 25 and an air cleaner 26 are connected via an induction manifold 24. Air is supplied to the mixer 25 through the air cleaner 26. A fuel supply control valve 28 operated by a pulse motor, a zero governor (reduced-pressure control valve) 29, and an electromagnetic valve (gas on-off valve) 30 are connected to the mixer 25 via a connection pipe 27, thereby supplying fuel gas to the mixer 25. Fuel gas and air are mixed in the mixer 25, and then introduced into the water-cooled engine 23.

A replenishing control valve is connected to the water-cooled engine 23 via an oil (lubricant) replenishing line 32 leading to an oil (lubricant) tank 34 disposed at an upper position so that when the amount of oil is decreased, the replenishing control valve is automatically opened, and oil is supplied to the water-cooled engine 23 by gravity from the oil (lubricant) tank 34.

A muffler 36, an exhaust silencer 37, and a mist separator 38 are also connected to the water-cooled engine 23 via an exhaust pipe 35. Exhaust from the water-cooled engine 23 is cooled while flowing through the muffler 36 and the exhaust silencer 37, thereby generating drain water with acidic material separated from exhaust gas. Also, in the mist separator 38, drain water with acidic material is separated from exhaust gas. The above drain waters are fed to a drain neutralizer 40 via respective pipes 39, in which the drain water is neutralized, thereby being discharged. The engine unit 2 is provided with a heater 41 which controls the temperature of oil in an oil pan in the water-cooled engine 23.

The compressor system unit 3 has two compressors A and B, both of which are connected to a drive shaft 44 of the water-cooled engine 23 via respective electromagnetic clutches 43. These electromagnetic clutches 43 can be engaged or disengaged using clutch drive members (not shown). Referential numeral 45 is a heater for controlling the temperature of oil in the compressors A and B, and is activated at start-up at a low temperature.

The refrigerant circulation line 6 permits refrigerant to be compressed, circulated, vaporized, and liquefied, thereby performing heat-pumping. The refrigerant circulation line 6 is constituted by a basal circulation line 47 from the compressors A and B of the compressor system unit 3 to a four-way valve 46; an inside circulation line 48 accommodated in the inside unit 22; and an outside circulation line 49 disposed between the basal circulation line 47 and the inside circulation line 48.

The basal circulation line 47 is constituted by a discharge circulation line 50 connected to the compressors A and B on the discharging side and communicated to a first port 46*a* of the four-way valve 46, and a intake circulation line 51 connected to the compressors A and B on the intake side and communicated to a second port 46*b* of the four-way valve 46. The discharge circulation line 50 is provided with an oil separator 52 having a heater 53 that controls the temperature of the oil separator 52. The oil separator 52 permits oil to return to a line upstream of a subaccumulator 56 through a capillary tube 55 via a strainer 54, and also to return to a line upstream of an accumulator 58 via an electromagnetic valve 57. The electromagnetic valve 57 opens normally at start-up when oil abundantly discharged from the compressors A and B accumulates in the oil separator 52; otherwise, the valve 57 is closed.

The subaccumulator 56 and the accumulator 58 are provided in the intake circulation line 51. The accumulator 58 accommodates both liquid and vapor refrigerant therein. The vapor refrigerant is transferred to the subaccumulator 56 via a line 51*c* through a capillary tube 60, and via lines 51*d*, 51*e*, and 51*f*, and further via the lines 51*d*, 51*e*, and 51*f* through a strainer 61 and a capillary tube 62. The liquid refrigerant accommodated in the accumulator 58 is transferred to the subaccumulator 56 via the lines 51*d*, 51*e*, and 51*f* through a strainer 63 and a capillary tube 64. A heater 59 controls the temperature at the capillary tubes 62 and 64, and the strainers 61 and 63. Each of the strainers 61 and 63 is provided with a temperature sensor for sensing the low-temperature liquid refrigerant passing through the respective strainers, thereby detecting whether or not the surface of the liquid refrigerant is located between the strainers 61 and 63. In addition, the oil accomodated in the accumulator 58 is transferred from the lower part of the accumulator 58 to the subaccumulator 56 via a line 51*g* through a strainer 77 and a control valve 78 or an orifice 79, and via the lines 51*e* and 51*f*.

The subaccumulator 56 is provided with a heater 65 that controls the temperature of the subaccumulator 56. The vapor refrigerant in the subaccumulator 56 is introduced into the compressors A and B via lines 51*h* and 51*i* through respective one-way valves. The oil accommodated in the subaccumulator 56 is slowly taken into the compressors A and B via an orifice 66. The discharge circulation line 50 is connected to the intake circulation line 51 via a strainer 68 and an electromagnetic valve 69 that open when the pressure is irregularly high, thereby preventing the occurrence of irregularly high pressure.

A third port 46*c* of the four-way valve 46 is connected to a line 49*a* which constitutes the outside circulation line 49, and which includes an outside heat-exchanger 70. A heat-exchanger 72, a strainer 73, a line 49*b* provided with a manual valve 74, a joint (coupler) 75, and an electrical expansion valve 76 are provided between the outside heat-exchanger 70 and an inside heat-exchanger 71 included in the inside circulation line 48.

The inside heat-exchanger 71 is connected to the inside circulation line 48, and is communicated to a fourth port 46*d* of the four-way valve 46 positioned between the basal circulation line 47 and the outside circulation line 48 via a joint (coupler) 80, a line 49*c* constituting the outside circulation line 49, and a manual valve 81 positioned therebetween.

The intake circulation line 51 is connected to a line 49*b* constituting the outside circulation line 49 via a flow control valve 90*e* and a strainer 91*e*, and the discharge circulation line 50 is connected to the line 49*b* via a strainer 92, an electromagnetic valve 93, and a capillary tube 94.

The hot water line 5 comprises a heat-exchanger 82 provided in the water-cooled engine 23 that is a heat source of hot water, and a heat-exchanger 99 provided in a muffler 36, in which hot water is circulated by pumps 86 and 87 through a switch valve 83 having a thermostat, a three-way valve 84, a radiator 85, the pump 86, the heat-exchanger 99, and the pump 87, in sequence. The radiator 85 is provided with cooling fan 96. The air and water vapor are returned to a conduction assembly (water-pouring hole cap) 98 through the switch valve 83, and then discharged to the atmosphere through the conduction assembly 98. A recovery tank (cooling water replenishing tank) 89 for supplying cooling water is connected to the conduction assembly 89, and the cooling water is supplied between the radiator 85 and the pump 86 via a cooling water pipe 97 from the conduction assembly 98.

At start-up, hot water is circulated using the pump 87 in a loop via the heat-exchanger 82 by manipulating the switch valve 83 until the temperature of the hot water reaches a given value.

Hot water is fed to the heat-exchanger 88 positioned in the accumulator 58 by manipulating the three-way valve 84, thereby promoting vaporization of liquid refrigerant accommodated in the accumulator 58.

Thus, when operating the heat pump system 1 having the above structures for cooling a room, as shown in FIG. 2, the four-way valve 46 is controlled in such a way as to connect the first port 46*a* and the third port 46*c*, and concurrently the fourth port 46*d* and the second port 46*b*.

Accordingly, refrigerant is compressed by the compressors A and B driven by the water-cooled engine 23, whereby the generated high-temperature high-pressure vaporized refrigerant is cooled by the outside air so as to be liquefied in the outside heat-exchanger 70 of the outside unit 21. The liquefied refrigerant is decompressed (subjected to pressure reduction) by the function of the expansion valve 76, and the refrigerant under low pressure is vaporized while absorbing heat from the inside air in the inside heat-exchanger 71 of the inside unit 22. The heat of evaporation drives the cooling effect to cool the room. The evaporated refrigerant is returned to the compressors A and B, and the same cycle is repeated. Hot water, which circulates through a hot water heat-exchanger 88 via the three-way valve 84 from the hot water circulation line 5, supplies heat energy to liquid refrigerant in order to compensate for insufficient vaporization at the inside heat-exchanger 71.

Figure 3:
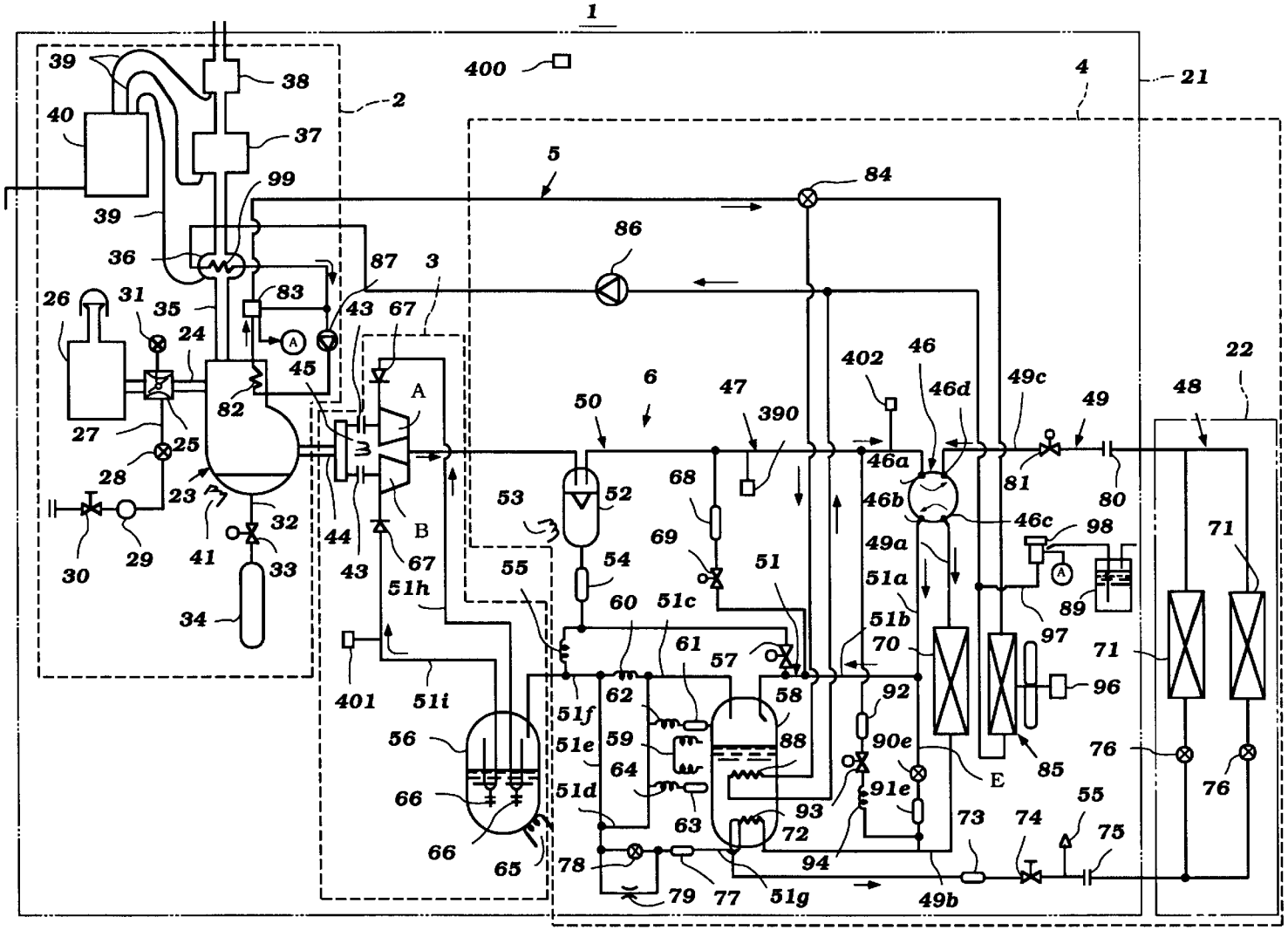
FIG. 3 is a schematic circuit illustrating structures of the air-conditioning apparatus of FIG. 2 when in the heating mode, according to an embodiment of the present invention.

When operating the heat pump system 1 for heating a room, as shown in FIG. 3, the four-way valve 46 is controlled in such a way as to connect the first port 46*a* and the through port 46*d*, and concurrently the third port 46*c* and the second port 46*b*.

Accordingly, refrigerant is compressed by the compressors A and B driven by the water-cooled engine 23, whereby the generated high-temperature high-pressure vaporized refrigerant is cooled by the outside air so as to be liquefied in the inside heat-exchanger 71 of the inside unit 22. In this process, the refrigerant radiates heat towards the inside air due to the heat-emitted so as to heat the room. The liquefied refrigerant is decompressed (subjected to pressure reduction) by the function of the expansion valve 71, and the refrigerant under low pressure is vaporized while absorbing heat from the outside air in the outside heat-exchanger 70 of the outside unit 21. The liquid refrigerant is separated in the accumulator 58, and the vapor refrigerant is returned to the compressors A and B, and the same cycle is repeated. Hot water, which circulates through a hot water heat-exchanger 88 via the three-way valve 84 from the hot water circulation line 5, supplies heat energy to liquid refrigerant in order to compensate for insufficient vaporization at the outside heat-exchanger 70.

The compressor system unit 3 of the air-conditioning apparatus 1 will be explained with reference to FIGS. 4–8.

Compressor System Unit

The compressor system unit 3 of the air-conditioning apparatus 1 comprises two multi-blade type compressors A and B which are driven by the water-cooled engine 23. The structures of one of the compressors, compressor A, are explained with reference to FIGS. 5–8. The structures of compressor B are the same as compressor A, and thus explanation of compressor B is omitted.

The compressor system unit 3 has a rotor housing 100, one side of which is affixed to a compressor casing 200 with clamping bolts (fasteners) 201. To the other side of the rotor housing 100, caps 300 to compressor A and B, respectively, are affixed with clamping bolts (fasteners) 301.

Figure 5:
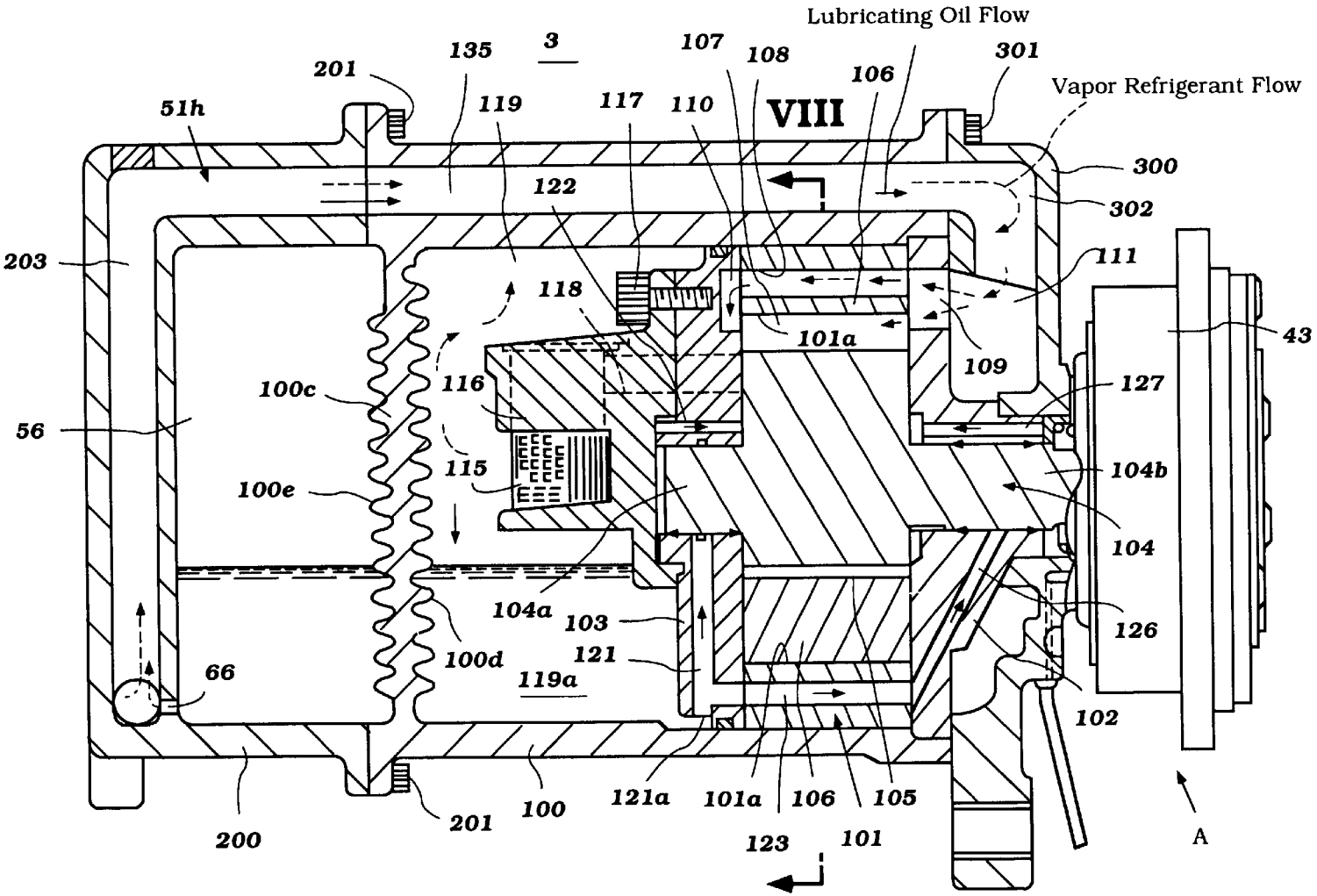
FIG. 5 is a schematic cross-sectional view of the compressor system of FIG. 4, which is cross-sectioned along the V—V line.
Figure 8:
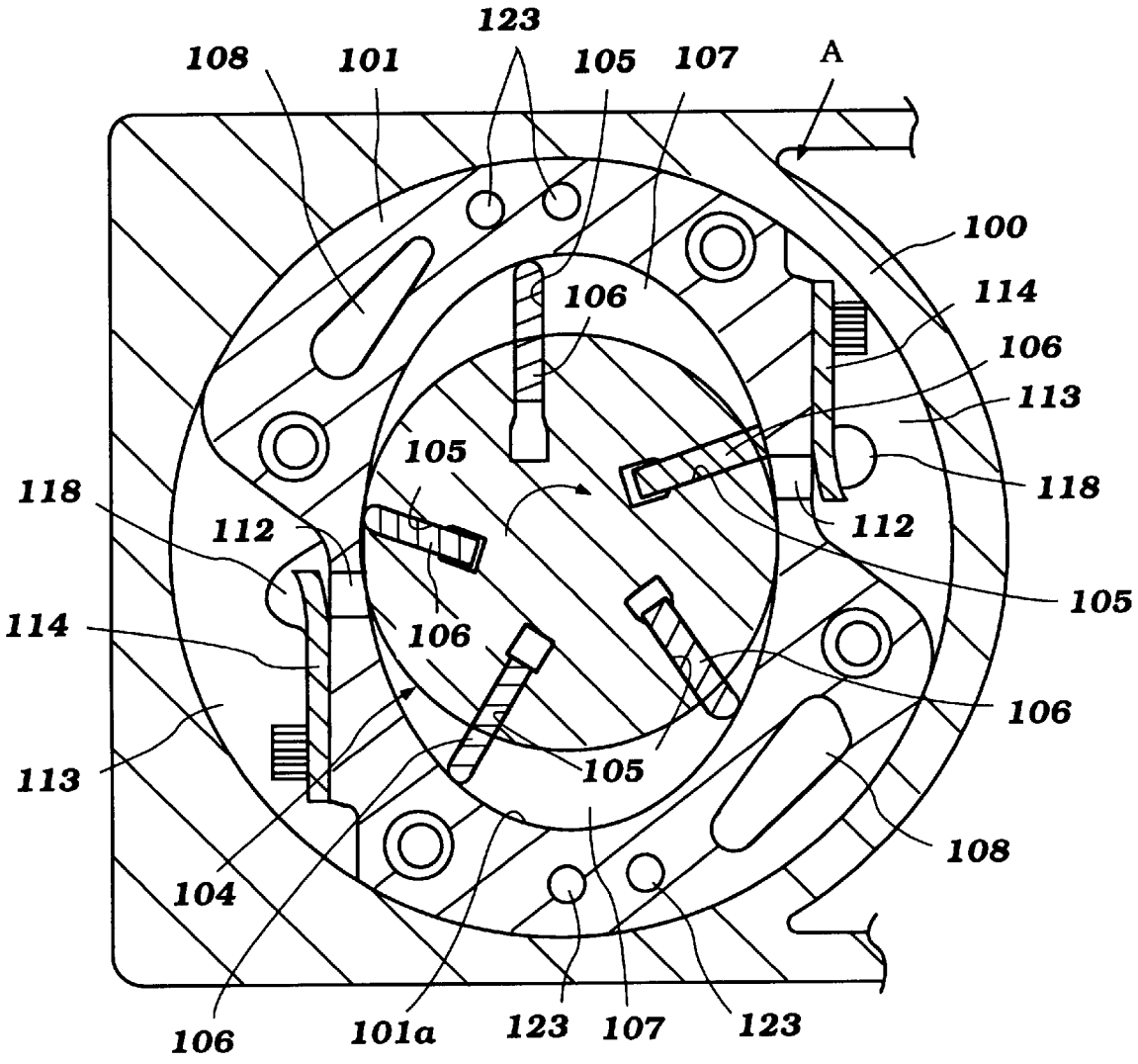
FIG. 8 is a schematic cross-sectional view of the compressor system of FIG. 4, which is cross-sectioned along the VIII—VIII line.

As shown in FIG. 5, in the rotor housing 100, a cylinder 101 is accommodated, and side blocks 102 and 103 are attached to respective ends of the cylinder 101. Also, in the cylinder 101, shafts 104*a* and 104*b* of a rotor 104 are pivoted to the side blocks 103 and 102 so as to make it freely rotatable. The rotor 104 has a main portion which has a large diameter and which is positioned between the shafts 104*a* and 104*b* in the cylinder 101. As shown in FIG. 8, the main portion has structures having five vane-sliding slots 105, each formed approximately in a radial direction. Into each sliding groove, a vane 106 is fitted in such a way as to freely slide in a radial direction, and when the rotor 104 rotates in the direction indicated by the arrow, each vane 106 revolves while the outer end of the blade slides upon the inner wall of a bore 101*a* having an elliptical cross-section. In the cylinder 101, five compartments (pumping chambers) 107 for induction and compression of refrigerant are defined by the rotor 104.

The cylinder 101 is provided with a pair of induction conduits 108 which go through the cylinder 101 in the axis direction. Induction inlets 109 and 110, which are communicated to the induction and compression compartment 107, are formed in the side blocks 102 and 103, respectively (FIG. 5). The induction inlet 109 is communicated directly to the induction channel 111, and the induction inlet 110 is communicated to the induction channel 111 via the induction conduit 108. The induction channel 111 is formed between the side block 102 and the cap 300. As shown in FIG. 8, two discharge outlets 112, which are openings communicating to the induction and compression compartments 107, are formed, and each discharge outlet 112 is provided with a valve 114 which allows vapor refrigerant to flow from the induction and compression compartment 107 to a discharge compartment 113.

As shown in FIG. 5, a holder 116 having an oil separator 115 is affixed to the side block 103 with a hexagon socket head cap screw 117. The discharge compartment 113, which is formed by the side blocks 102 and 103, the rotor housing 100, and the cylinder 101, is communicated to the oil separator 115 via discharge conduit 118 that is an opening communicating to the discharge compartment 113. An oil reservoir (oil storage chamber) 119 wherein oil is stored in the lower part is formed behind the cylinder 101 in the rotor housing 100, in which lubricating oil 119*a* is stored. There is an opening, a discharge outlet 120, in the upper part of the rotor housing 100 above the oil reservoir 119, and the discharge outlet 120 is communicated to the discharge circulation line 50 (FIG. 7).

The oil reservoir 119 is also used as a high-pressure refrigerant chamber, and accommodates lubricating oil therein. There is an opening, an oil inlet 121*a*, in the lower part of the oil reservoir 119. The oil inlet 121*a* is communicated to an oil circulation conduit 121 formed in the side block 102. The oil circulation conduit 121 is led to the shaft unit 104*a* of the rotor 104 so as to supply lubricating oil, thereby lubricating the shaft unit. The side block 102 is also provided with an oil circulation conduit 122 which is communicated to the shaft unit 104*a* of the rotor 104. The lubricating oil, which has lubricated the shaft unit 104*a*, is then moved from the oil circulation conduit 122 to a gap between the side block 102 and the rotor 104, thereby lubricating therebetween (FIG. 5). Four oil circulation conduits 123 are formed in the cylinder 101. The oil circulation conduits 123 are communicated to the oil circulation conduit 121 of the side block 103. The side block 102 is provided with oil circulation conduits 126 and 127. The oil circulation conduit 126 is led to the shaft unit 104*b* of the rotor 104 via the oil circulation conduits 123 of the cylinder 101, thereby lubricating the shaft unit 104*b*. The oil circulation conduit 127 is communicated to the shaft unit 104*b* of the rotor 104, and the lubricating oil, which has lubricated the shaft unit 104*b*, is then moved to a gap between the side block 103 and the rotor 104 from the oil circulation conduit 127, thereby lubricating therebetween, and is led to the induction and compression compartment 107.

Figure 7:
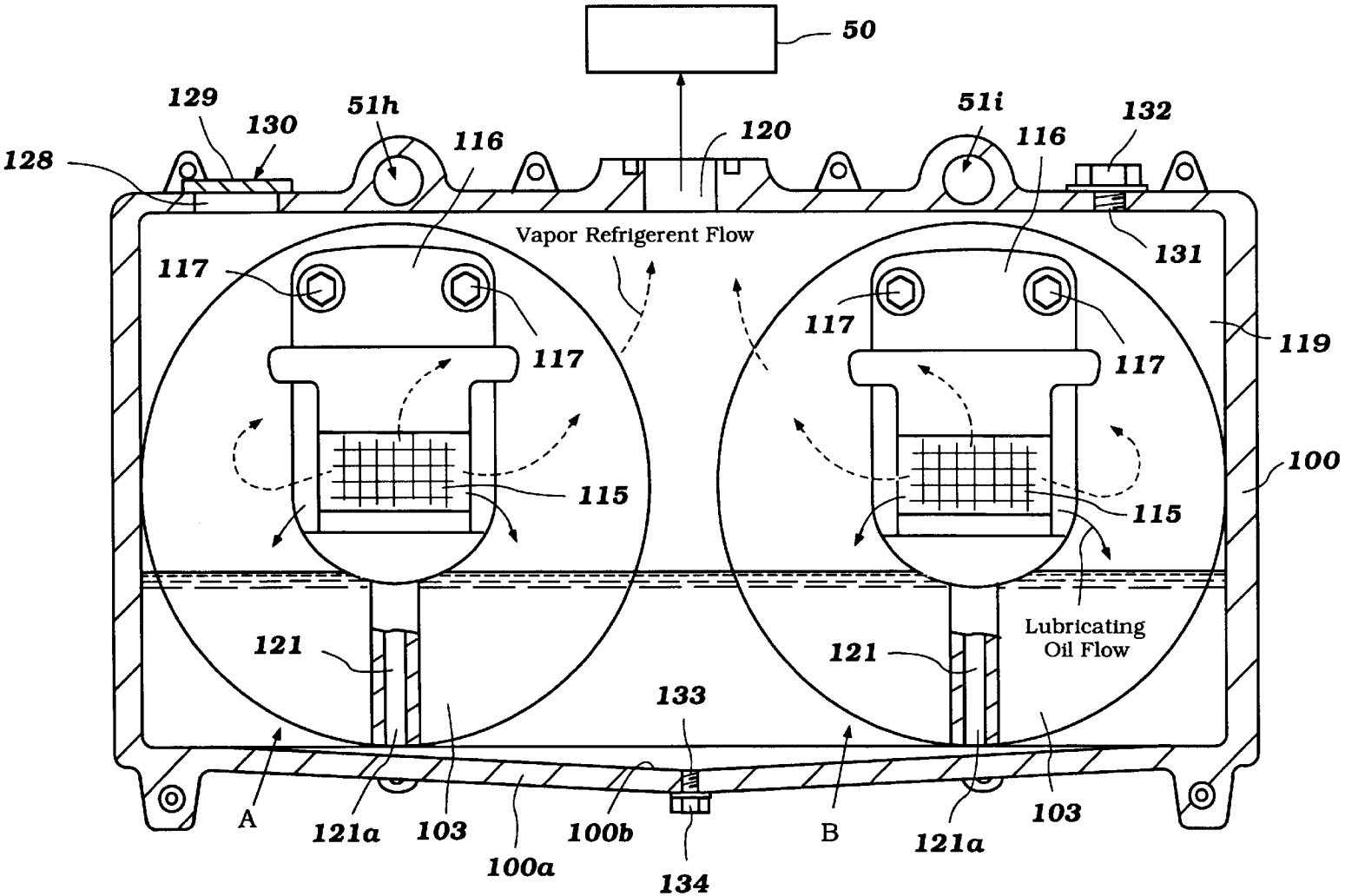
FIG. 7 is a schematic cross-sectional view of the compressor system of FIG. 4, which is cross-sectioned along the VII—VII line.

At the upper part of the rotor housing 100, an observation port 130 is provided by sealing an opening 128 with a transparent glass 129 (FIG. 7). An oil charging hole 131 is provided on the side opposite to the observation port 130. An oil charging hole cap (bolt) 132 is removed from the oil injection inlet 131, and oil is injected thereto. The bottom 100*a* of the rotor housing 100 is slanted so that the center 100*b* of the bottom 100*a* is made lower than the sides, whereby lubricating oil drainage can be accumulated therein. The center 100*b* of the bottom 100*a* is provided with an oil drain hole 133, through which lubricating oil is discharged and replaced, or drained at a certain time after removing a drain hole cap (bolt) 134.

The rotor housing 100 is attached to the compressor casing 200 with clamping bolts 201, and the oil reservoir 119 for accommodating lubricating oil therein and the subaccumulator 56 are contiguous to each other, in which a heat-exchange wall 100*c* formed in the rotor housing 100 is interposed therebetween (FIG. 5). The heat-exchange wall 100*c* is provided with fins 100*d* on the side of the oil reservoir 119, and also provided with fins 100*e* on the side of the subaccumulator 56, thereby enlarging the heat-exchanging area, and improving heat exchange efficiency.

Figure 4:
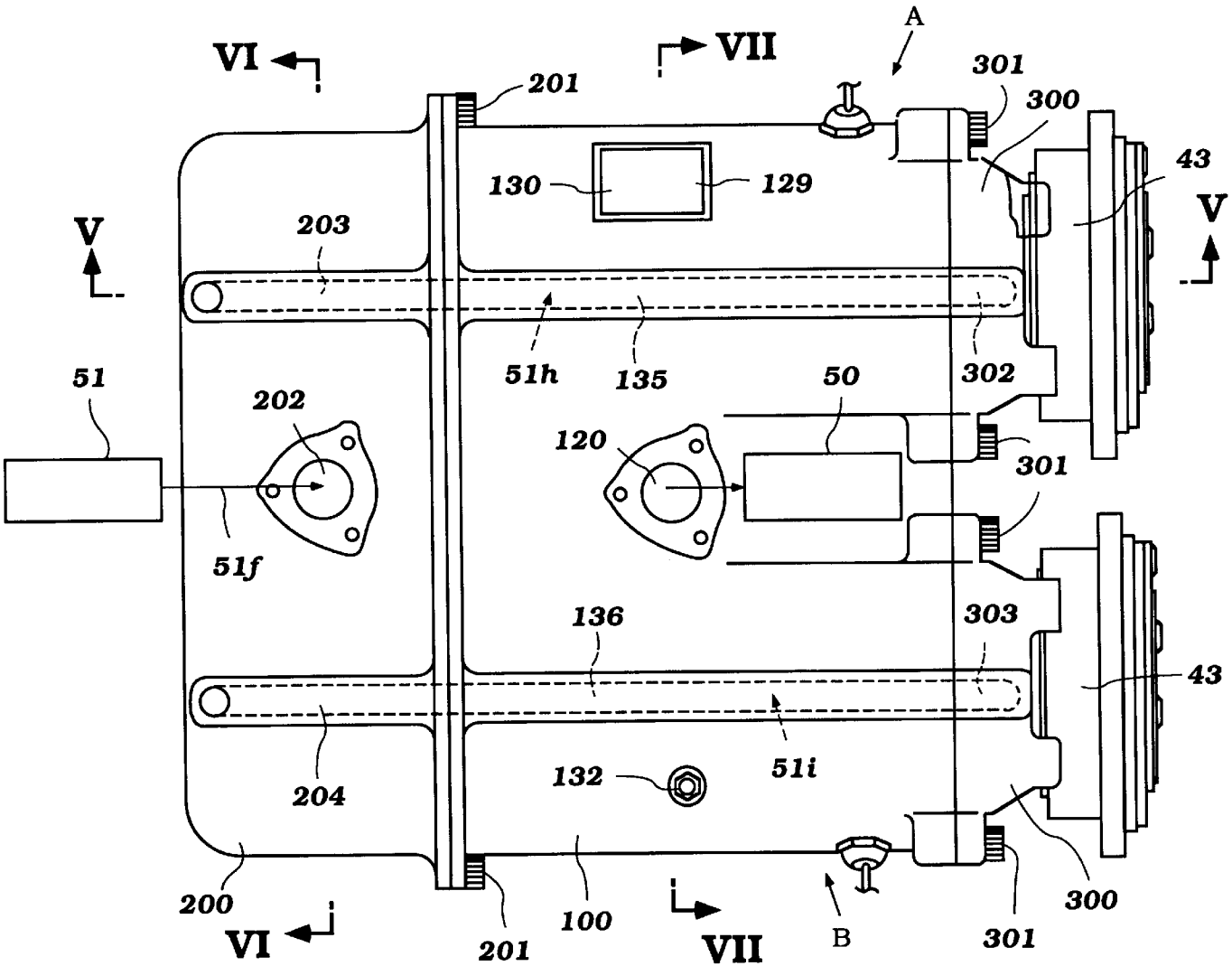
FIG. 4 is a schematic plane view illustrating a compressor system usable in the present invention.
Figure 6:
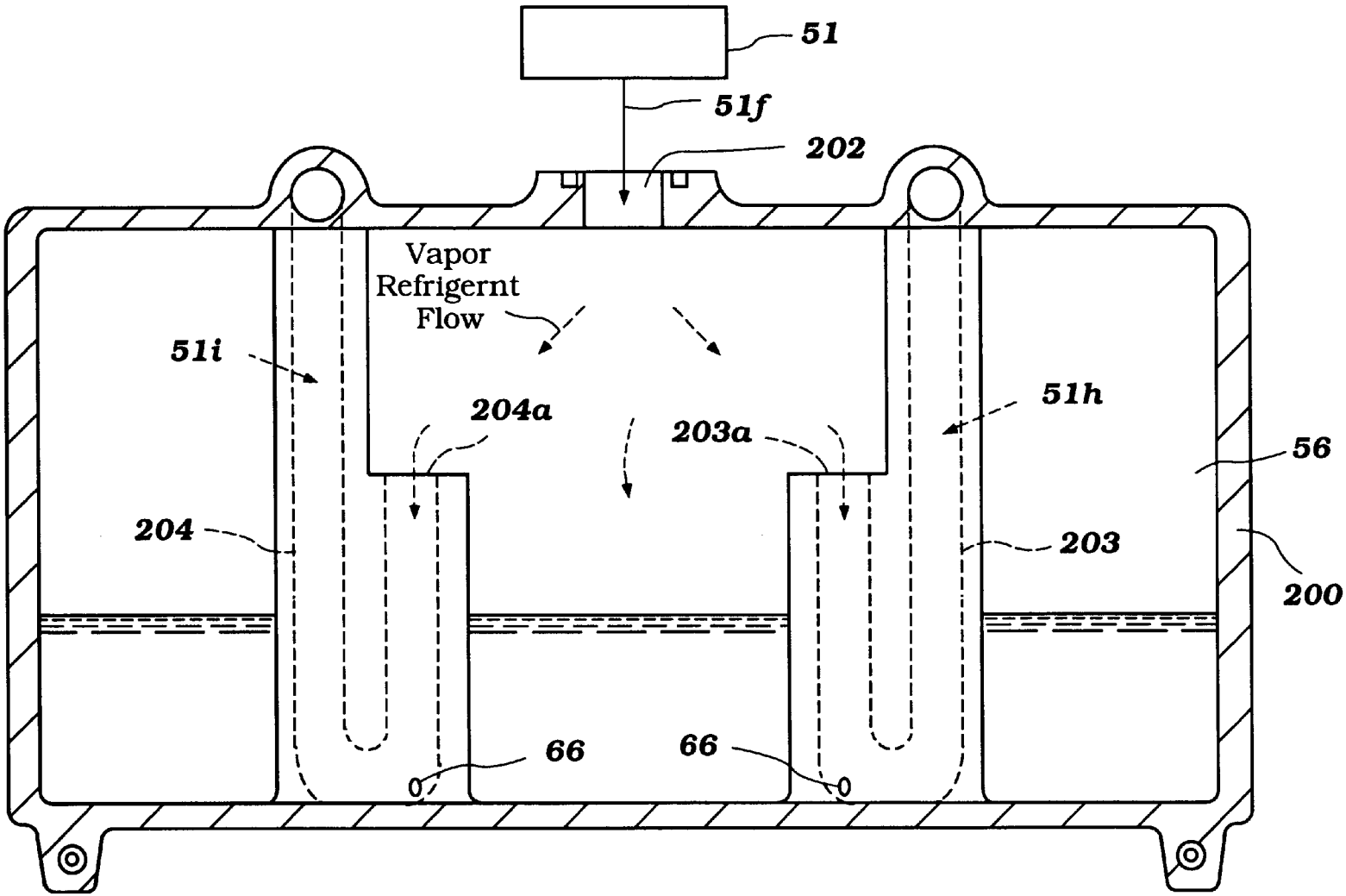
FIG. 6 is a schematic cross-sectional view of the compressor system of FIG. 4, which is cross-sectioned along the VI—VI line.

The subaccumulator 56 is a low pressure chamber, and the upper part of the subaccumulator 56 is provided with an opening, an induction inlet 202, connected to a circulation line 51*f* of the intake circulation line 51 (FIGS. 4 and 6). A pair of conduits 203 and 204 are formed from the side to the upper part of the compressor casing 200, and the conduits 203 and 204 are communicated to conduits 135 and 136, respectively, formed in the upper part of the rotor housing 100. The conduits 135 and 136 are communicated to conduits 302 and 303, respectively, formed in the cap 300. The conduits 302 and 303 are in turn communicated to the induction channel 111 (FIG. 5).

There are openings 203*a* and 204*a* in the middle of the subaccumulator 56, which are communicated to the conduits 203 and 204, respectively (FIG. 6). Through the openings 203*a* and 204*a*, vapor refrigerant present in the subaccumulator 56 is taken by and introduced into the compressors A and B in operation, respectively. That is, by operation of the compressor A, vapor refrigerant present in the subaccumulator 56 is taken into the compressor A via the conduits 203, 135, and 302, and the induction channel 111, thereby forming a circulation line 51*h* (FIG. 5). On the other hand, by operation of the compressor B, vapor refrigerant present in the subaccumulator 56 is taken into the compressor B via the conduits 204, 136, and 303, and the induction channel 111, thereby forming a circulation line 51*i*.

The lubricating oil remaining in the subaccumulator 56 are slowly taken into the compressors A and B through an orifice 66.

Accordingly, by adjoining the oil reservoir 119 for accommodating lubricating oil and the subaccumulator 56 via the heat-exchange wall 100*c* interposed therebetween, and further by integrating the compressors A and B and the subaccumulator 56, it is possible to eliminate piping connecting the compressors A and B and the subaccumulator 56, reduce the production cost, and downsize the apparatus.

Further, by adjoining the oil reservoir 119 for accommodating lubricating oil and the subaccumulator 56 via the heat-exchange wall 100*c* interposed therebetween, lubricating oil present in the oil reservoir 119 is cooled by exchanging heat between the oil and the liquid refrigerant present in the subaccumulator 56, and it is possible to eliminate a specific radiator for cooling the lubricating oil, thus reducing the production cost. On the other hand, the refrigerant in the subaccumulator 56 is concurrently heated by the lubricating oil in the oil reservoir 119.

In brief, each rotor 104 of the compressors A and B is provided with an electromagnetic clutch 43 at the end of the rotor, and driving power generated by the water-cooled engine 23 is transmitted to the rotor 104 according to the ON/OFF operation of the electromagnetic clutch 43. When driving power is transmitted to the rotor 104 and the rotor 104 starts rotation, the vanes 106 revolves together. The vanes 106 slide upon the walls of the vane-sliding slots 105 in the outward direction, thereby revolving while the edges of the vanes 106 slide upon the wall of the bore 101*a* of the cylinder 101. Vapor refrigerant is taken into the compression compartment 107 in the cylinder 101 via the induction channel 111, the induction inlet 109, and the induction conduit 108. The vapor refrigerant is then compressed by the vanes 106, thus turning it into high-temperature high-pressure vapor refrigerant, which is discharged to the discharge compartments 113 via the discharge outlets 112 and the valves 114 (FIG. 8). The vapor refrigerant discharged to the discharge compartment 113 reaches the oil separator 115 via the discharge conduit 118, where the oil portion is separated therefrom, flows into the oil reservoir 119, and is finally discharged to the discharge circulation line 50 which is an outside system through the discharge outlet 120 (FIG. 7).

As explained above, the compressors A and B are provided with the conduits to circulate lubricating oil in the liquid refrigerant accommodated in the subaccumulator 56, thereby exchanging heat between the lubricating oil and the refrigerant. Thus, a special radiator for cooling lubricating oil can be eliminated, thereby reducing the production cost.

The lubricating oil, which has been separated from the liquid refrigerant by the oil separator 115, drips from the oil separator 115 and is accommodated in the lower part of the oil reservoir 119. The lubricating oil then flows from the oil inlet 121*a* towards the direction indicated by the arrow in FIG. 5 via the oil circulation conduits 121, 122, 126, and 127, and lubricates the shaft unit of the rotor 104, the gap between the rotor 104 and the side blocks 102 and 103, and the sliding area of the bore 101*a* and the vanes 106, especially the area under low pressure. The lubricating oil then moves to the pumping chamber 107 and further to the outlet conduit 118 and the oil separator 115, and drips to return to the oil reservoir 119 by dripping.

At start-up, the vapor refrigerant including lubricating oil, which has been liquefied inside the bore 101*a* and inside the conduits 51*h* and 51*i* located between the subaccumulator 56 and the compressors A and B, turns into foam, and is discharged to the discharge circulation line 50, i.e., outside the compressor system unit, via the discharge outlet 120 of the oil reservoir 119. The lubricating oil contained in vapor refrigerant, which is in the form of foam, is accommodated in the oil separator 52 in the discharge circulation line 50 (FIG. 2), and moves to the accumulator 58 via the electromagnetic valve 57 which opens after a given time elapses.

The lubricating oil accommodated at the bottom of the accumulator 58 returns through the lower part of the accumulator 58 to the subaccumulator 56 which is integrated with the compressors A and B via the conduit 58*g*, the strainer 77, the control valve 78, the orifice 79, the lines 51*e* and 51*f*.

The lubricating oil is slowly taken from the subaccumulator 56 to the compressors A and B through the orifice 66, moves into the bore 101*a* with vapor refrigerant, returns to the oil separator 115 via the discharge conduit 118, and drips from the oil separator 115 to return to the oil separator 52. After a given time elapses, the electromagnetic valve 57 closes, the circulation of the lubricating oil accommodated in the oil separator 52 via the electromagnetic valve 57 is discontinued. The lubricating oil accommodated in the oil separator 52 is slowly circulated via the capillary tube 55 during operation.

Heat Capacity Balancing Structures

Figure 9:
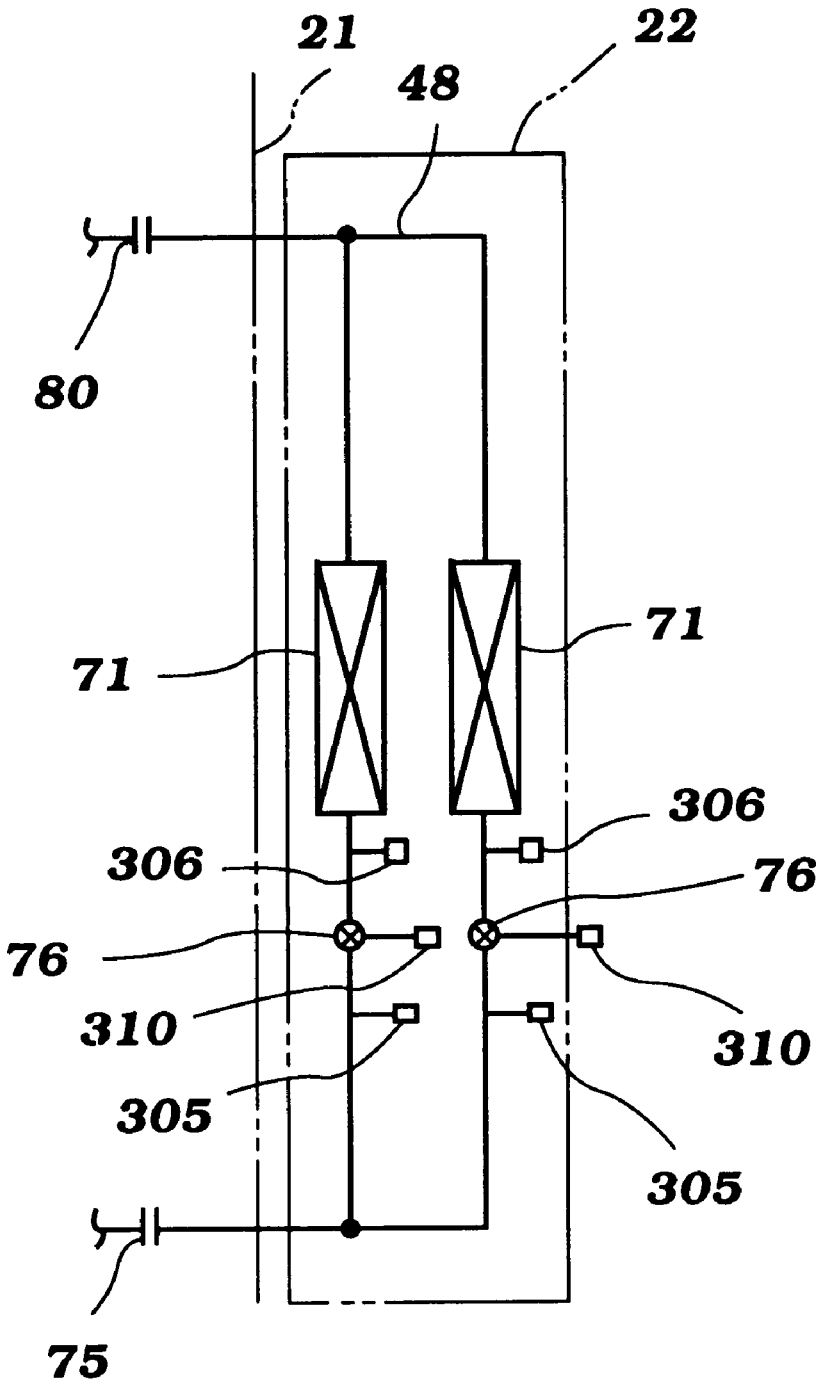
FIG. 9 is a schematic partial circuit illustrating structures of an inside heat-exchanger unit which replaces that of an engine-driven air conditioning apparatus of FIGS. 2 or 3, according to a second embodiment of the present invention.
Figure 10:
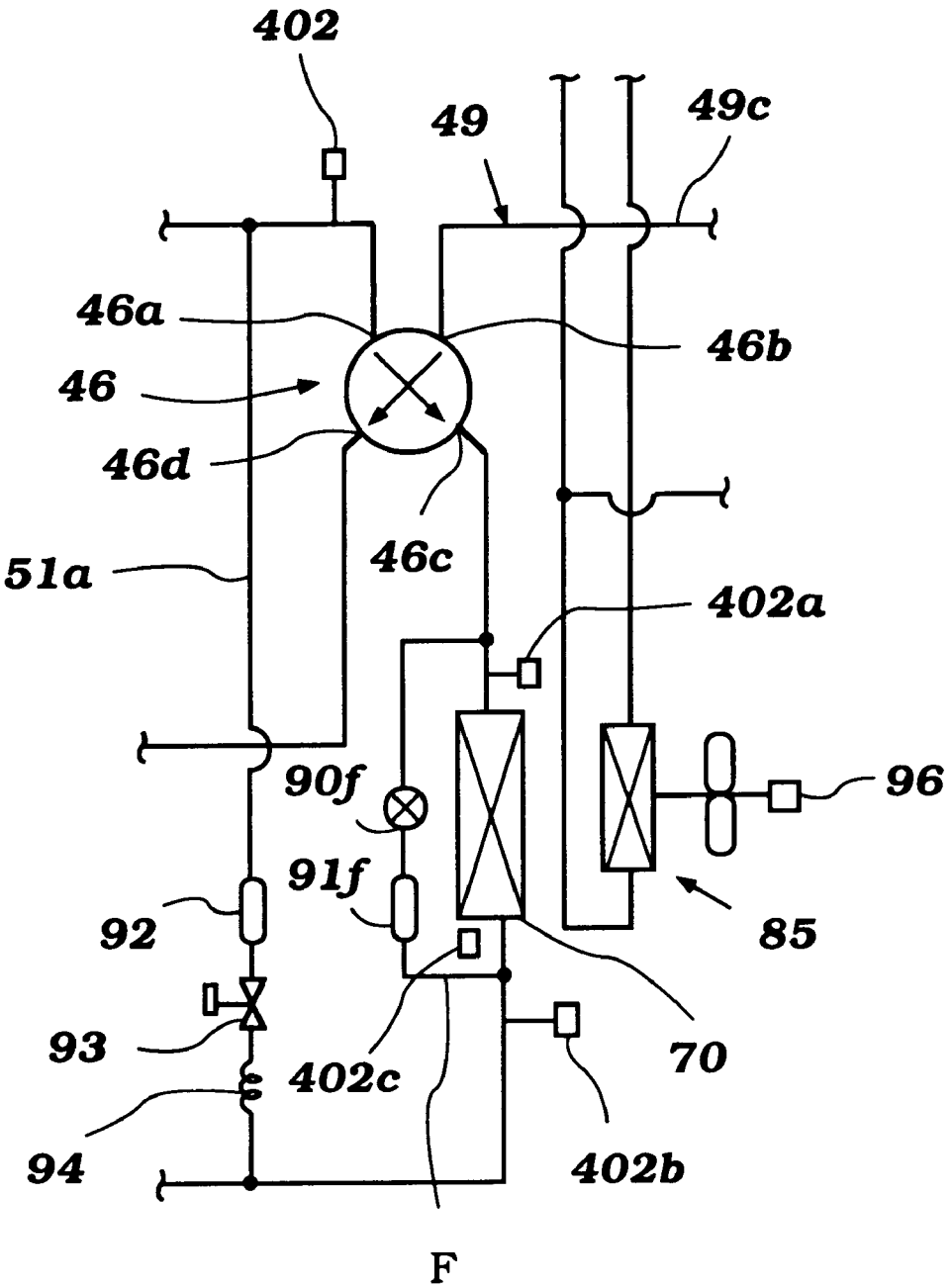
FIG. 10 is a schematic partial circuit illustrating structures of an area surrounding a four-way valve and an outside heat-exchanger, which replaces that of an engine-driven air conditioning apparatus of FIGS. 2 or 3, according to a third embodiment of the present invention.
Figure 11:
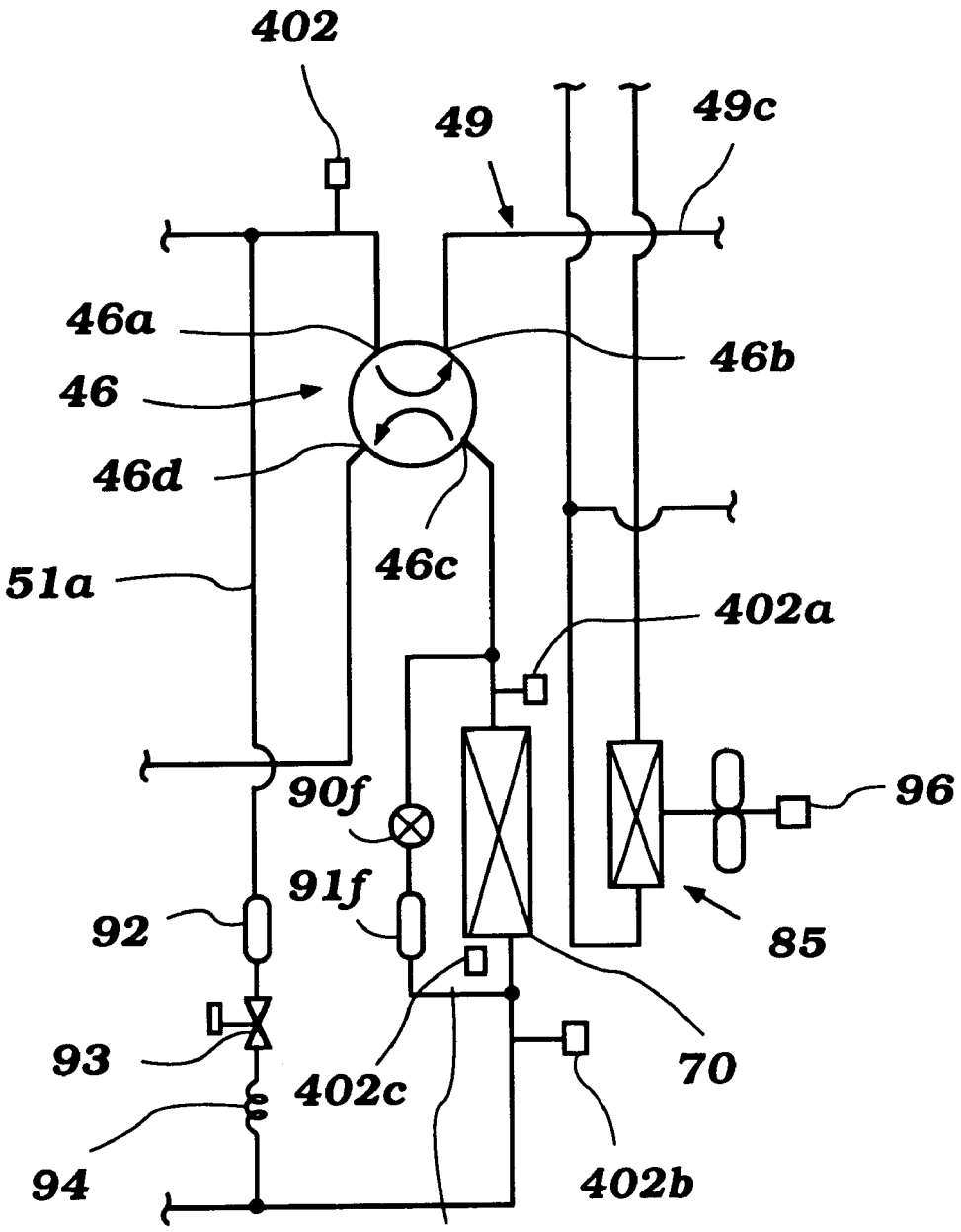
FIG. 11 is a schematic partial circuit illustrating structures of an area surrounding a four-way valve and an outside heat-exchanger (connecting ports of the four-way valve are different from those in FIG. 10) which replaces that of an engine-driven air conditioning apparatus of FIGS. 2 or 3, according to a third embodiment of the present invention.
Figure 12:
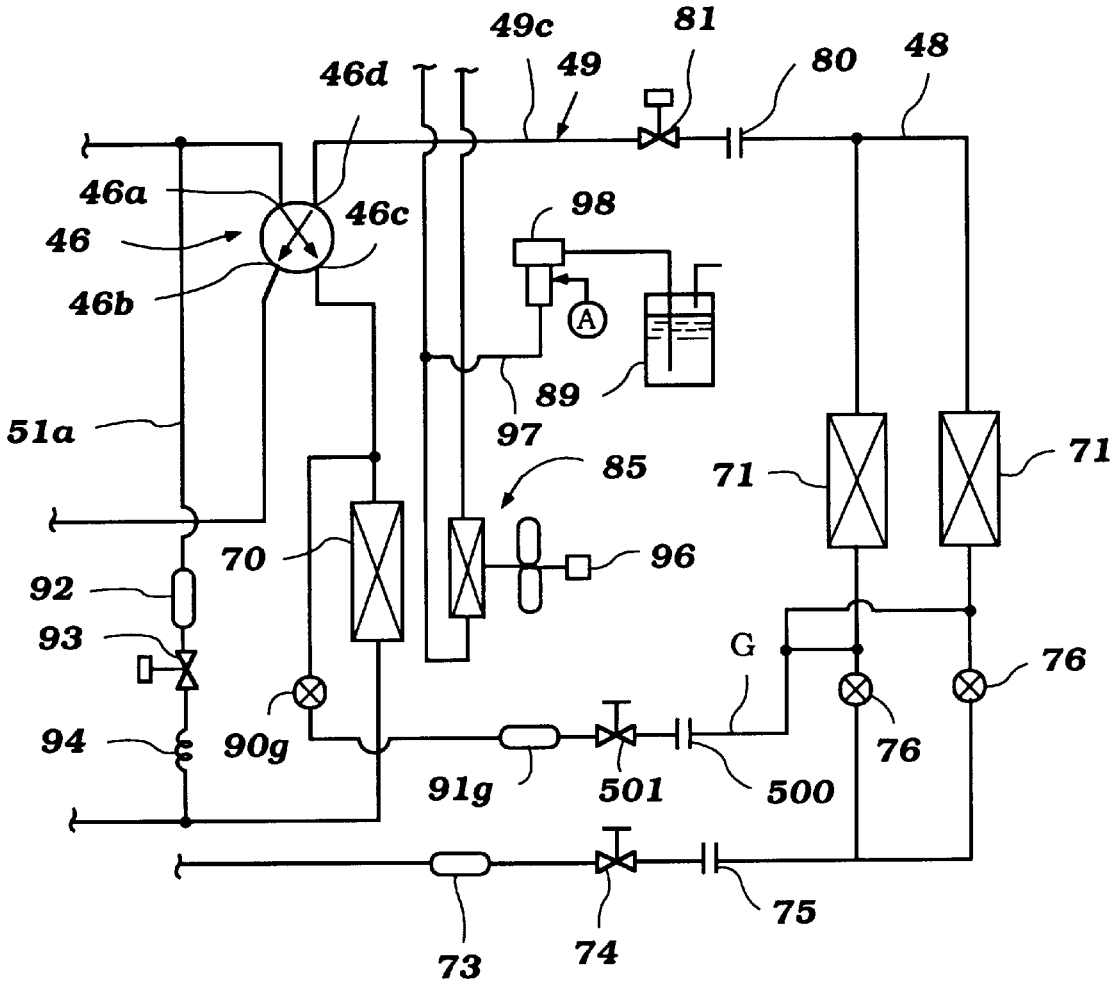
FIG. 12 is a schematic partial circuit illustrating structures of an area surrounding inside and outside heat-exchangers and a four-way valve, which replaces that of an engine-driven air conditioning apparatus of FIGS. 2 or 3, according to a fourth embodiment of the present invention.
Figure 13:
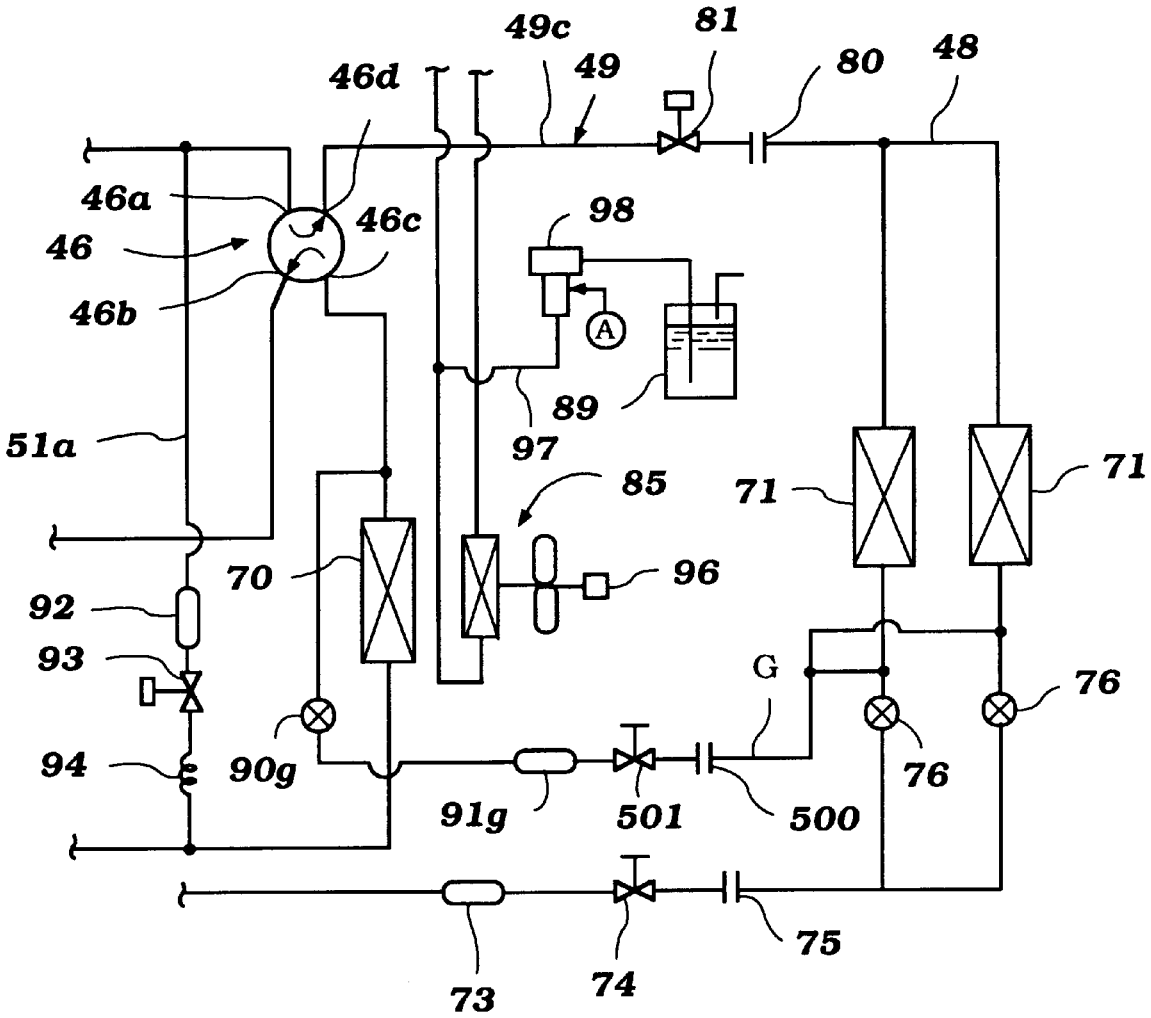
FIG. 13 is a schematic partial circuit illustrating structures of an area surrounding inside and outside heat-exchangers and a four-way valve (connecting ports of the four-way valve are different from those in FIG. 12), which replaces that of an engine-driven air conditioning apparatus of FIGS. 2 or 3, according to a fourth embodiment of the present invention.

The air-conditioning apparatus shown in FIGS. 1–3, particularly in the cooling mode shown in FIG. 2, represents a first embodiment of the present invention. FIG. 9 shows an inside unit 22*a*, a second embodiment of the present invention, replacing the inside unit 22 of the first embodiment. FIGS. 10 and 11 show a part of a refrigerant circulation line, a third embodiment of the present invention, replacing the corresponding part of the first embodiment. FIGS. 12 and 13 show a part of the system, a fourth embodiment of the present invention, replacing the corresponding part of the first embodiment.

FIG. 9 shows a schematic enlarged view of the inside unit 22*a* of the second embodiment. An expansion valve 76 used in the inside unit 22*a* is a linearly controlled expansion valve. A pressure sensor 305 for sensing high pressure when in the cooling mode is provided in the line upstream of the expansion valve 76, and a pressure sensor 306 for sensing low pressure when in the cooling mode is provided in the line downstream of the expansion valve 76. In addition, an expansion valve-opening sensor 310 for sensing the volume of refrigerant passing therethrough is provided in the expansion valve 76. When in the heating mode, the pressure sensor 305 senses low pressure, and the pressure sensor 306 senses high pressure, since the refrigerant flow is reversed when the operation mode is switched.

FIGS. 10 and 11 show a schematic partial enlarged view of an outside circulation line 49*a* of the third embodiment of the present invention, in which FIGS. 10 and 11 show the outside circulation line in the cooling mode and in the heating mode, respectively. A bypass line F, which communicates the line upstream and downstream of the outside heat-exchanger 70 by bypassing the outside heat-exchanger 70, is provided. A linearly controlled valve 90*f* and a strainer 91*f* are provided in the bypass line F so that the volume of the refrigerant passing through the bypass line F can be controlled by adjusting the opening of the linearly controlled valve 90*f*. Temperature sensors 402*a* and 402*b* are provided on the respective sides of (upstream and downstream of) the outside heat-exchanger 70. When in the cooling mode, the temperature of the refrigerant upstream of the outside heat-exchanger 70 is measured using the temperature sensor 402*a*, while the temperature of the refrigerant downstream of the outside heat-exchanger 70 is measured using the temperature sensor 402*b*. In addition, a temperature sensor 402*c* for sensing the temperature of the refrigerant passing through the outside heat-exchanger 70 is provided.

FIGS. 12 and 13 show a schematic enlarged view of a heat pump unit, the fourth embodiment of the present invention, replacing the corresponding part of the first embodiment, in which FIG. 12 shows the unit in the cooling mode and FIG. 13 shows the unit in the heating mode.

A bypass line G, which bypasses the outside heat-exchanger 70 and the expansion valve 76, is provided between the line upstream of the outside heat-exchanger 70 and the line downstream of the expansion valve 76 in the cooling mode. The line of the bypass line G outside the room and the line inside the room are connected with a coupler 500, and a linearly controlled valve 90*g*, a strainer 91*g*, and a manual valve 501 are provided in the bypass line G.

Heat Capacity Balancing System with Compensation Heat

In the present invention, as one embodiment of the energy-supplying mechanism for exerting energy onto the refrigerant, as shown in FIG. 2, the accumulator 58 is installed between the evaporator, i.e., the inside heat-exchangers 71, and the compressors A and B. In the accumulator 58, the hot water heat-exchanger 88 is provided to exert heat onto the refrigerant by utilizing exhaust heat from the engine.

As another embodiment of the energy-supplying mechanism for exerting energy onto the refrigerant, electrical heat is provided. As shown in FIG. 2, the heater 53, the heater 59, and the heater 65 are provided in the oil separator 52, the accumulator 58, and the subaccumulator 56, respectively.

As another embodiment of the energy-supplying mechanism for exerting energy onto the refrigerant, a heat-exchanging unit is provided to exchange heat between the refrigerant and the water-cooled engine 23 or the compressors A and B. As shown in FIGS. 4–8, the heat-exchanging mechanism is employed in the oil reservoir 119 for accommodating lubricating oil, i.e., the oil reservoir 119 and the subaccumulator 56 are adjoined with the heat-exchanging wall 100*c* interposed therebetween. Frictional heat, which increases in accordance with an increase in the rpm's of the compressors A and B, can be exerted onto the refrigerant.

In the above, stabilization of heat pumping operation by compensating for insufficient total heating-absorbing capacity can be achieved in such a way that the greater the difference between the total heat-emitting capacity and the total heating-absorbing capacity (or the ratio of the total heat-emitting capacity to the total heating-absorbing capacity), i.e., the lower the outside temperature when in the cooling mode, the higher the volume of hot water becomes, the higher the intensity of electric current passing through the heater becomes, or the higher the rpm's of the engine becomes. The total heat-emitting capacity is the capacity of the condenser, i.e., the outside heat-exchanger 70 when in the cooling mode, and the total heating-absorbing capacity is the capacity of the evaporator, i.e., the inside heat-exchanger 71 when in the cooling mode.

Figure 14:
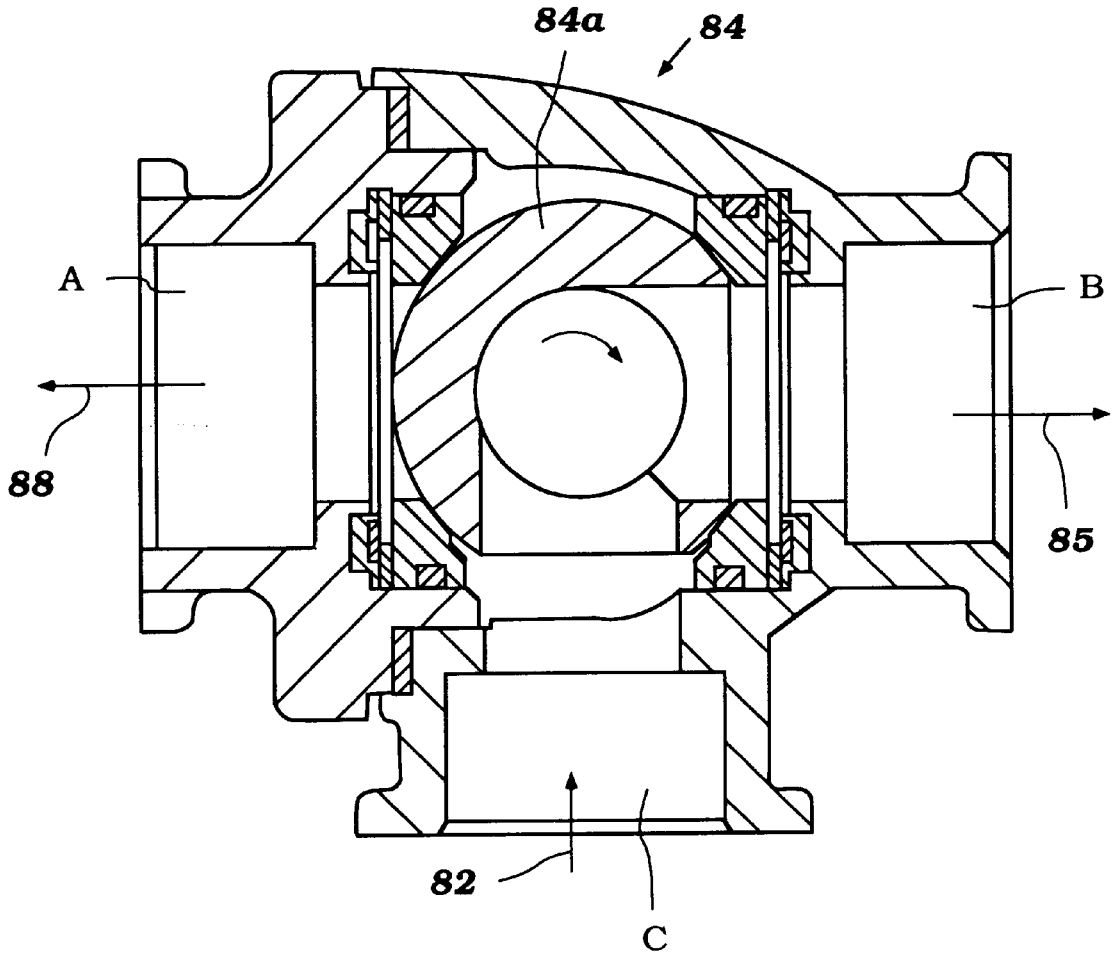
FIG. 14 is a schematic cross-sectional view illustrating structures of a three-way valve usable in the present invention, in which ports B and C are communicated.
Figure 15:
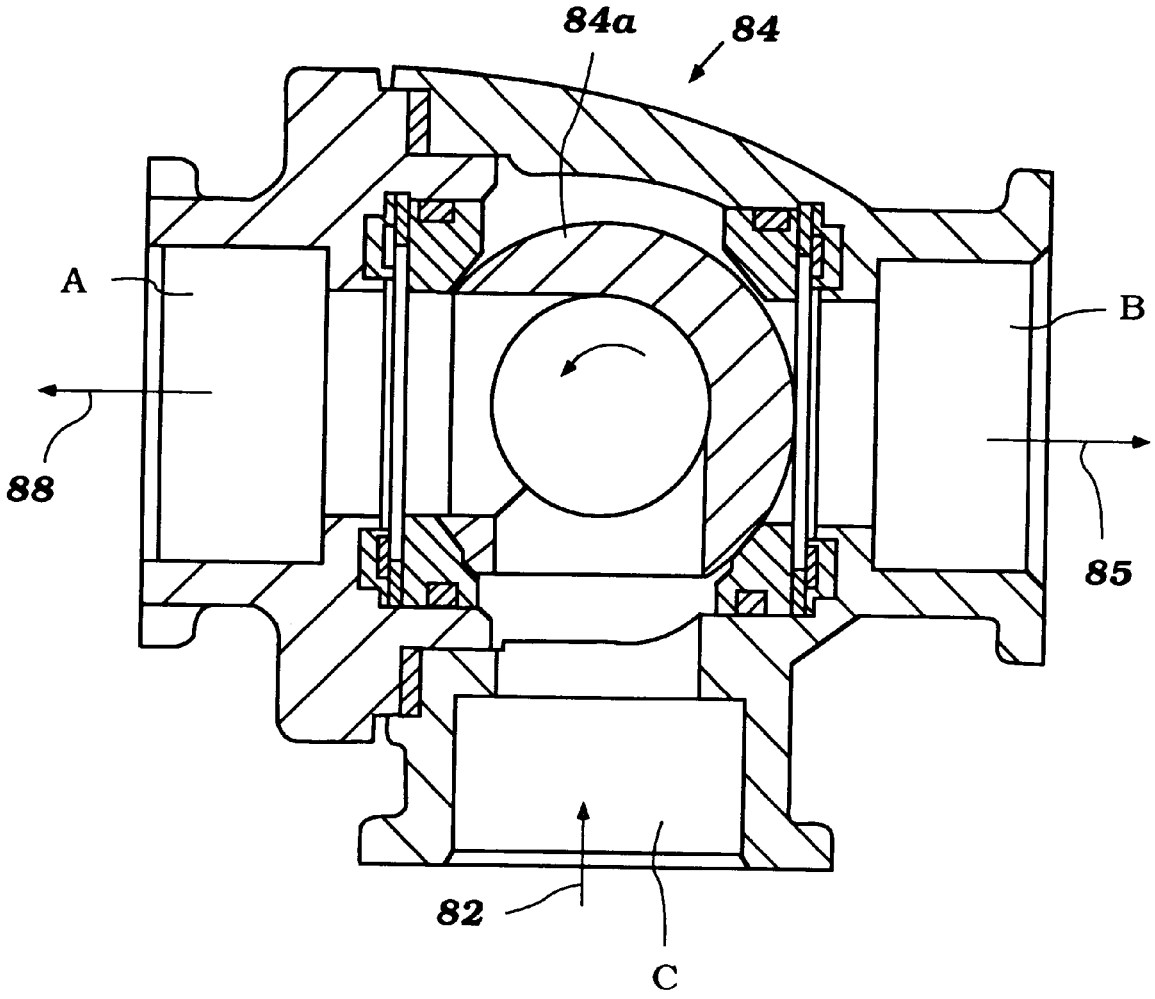
FIG. 15 is a schematic cross-sectional view illustrating structures of the three-way valve of FIG. 14, in which ports A and C are communicated.
Figure 16:
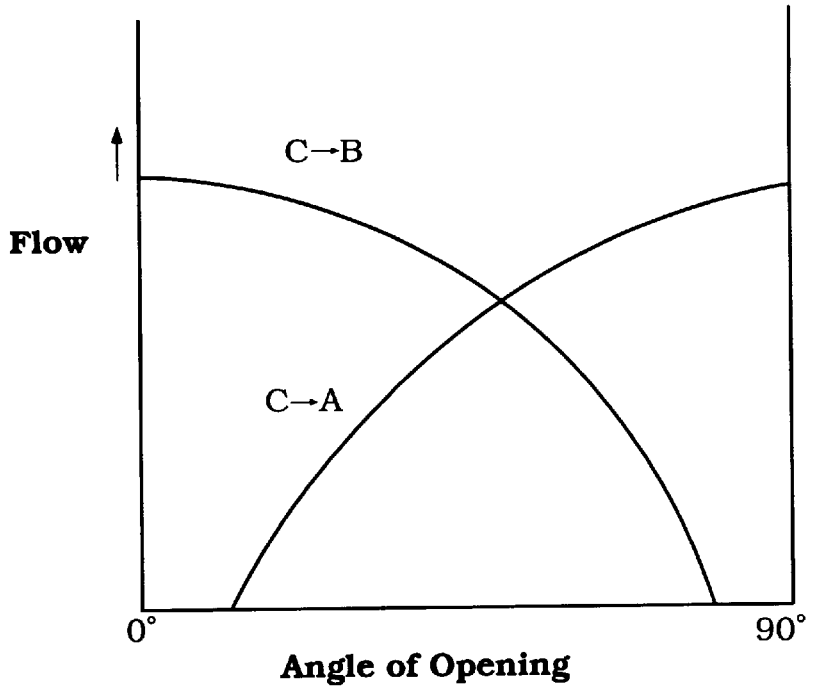
FIG. 16 is a schematic graph showing the relationship between the flow and the opening angle of valves of a three-way valve usable in the present invention.

For example, as shown in FIGS. 14 and 15, when the three-way valve 84 provided in the hot water circulation line 5 is a linearly controlled valve, a port A is communicated to the line connecting to the hot water heat-exchanger 88 in the accumulator 58, a port B is communicated to the line connecting to the radiator 85 of the outside unit 21, and a port C is communicated to the line connecting to the heat-exchanger 82 of the water-cooled engine 23. The opening of each port is controlled by rotating a rotary valve shaft 84*a*, thereby controlling the volume and the route of hot water flow.

When in the cooling mode, the greater the difference between the total heat-emitting capacity of the condenser and the total heat-absorbing capacity of the evaporator (or the ratio of the total heat-emitting capacity to the total heat-absorbing capacity), the more the rotary valve shaft 84*a* is rotated in such a way as to increase the flow of hot water from the port C to the port A, thereby exerting heat onto the refrigerant in the refrigerant circulation line, on the low pressure side, downstream of the inside heat-exchangers 71 functioning as an evaporator and upstream of the compressors A and B.

As described above, by (1) exerting heat onto the refrigerant; (2) increasing the rpm's of the compressors A and B; (3) increasing the number of engaged compressors, i.e., both compressors A and B are engaged; (4) discontinuing operation of a cooling fan motor 96 at the outside unit 21, in such a way as to increase the difference in pressure between the high pressure side and the low pressure side, it is possible to compensate for insufficient total heat-absorbing capacity.

Heat Capacity Balancing System with Refrigerant Flow Control

In addition, compensation for insufficient total heat-absorbing capacity can be achieved by: (1) as shown in FIG. 2, enlarging or controlling the opening of a linearly controlled valve 90*e* provided in the bypass line E which bypasses the expansion valve 76 and the inside heat-exchanger 71 functioning as an evaporate and communicates the refrigerant circulation line downstream of the outside heat-exchanger 70 functioning as a condenser and that downstream of the inside heat-exchanger 71 functioning as an evaporator; (2) as shown in FIG. 10, enlarging or controlling the opening of a linearly controlled valve 90*f* provided in the bypass line F which bypasses the condenser (outside heat-exchanger 70) and communicates the refrigerant circulation line upstream of the condenser and that downstream of the condenser; or (3) as shown in FIG. 12, enlarging or controlling the opening of a linearly controlled valve 90*g* provided in the bypass line G which bypasses the condenser (outside heat-exchanger 70) and the expansion valve 76 and communicates the refrigerant circulation line upstream of the condenser and that downstream of the expansion valve.

Accordingly, it is possible to control and reduce the flow ratio of the refrigerant passing through the inside heat-exchanger 71 (evaporator) to the refrigerant passing through the outside heat-exchanger 70 (condenser). The above bypass lines E, F, and G and valves 90*e*, 90*f*, and 90*g* function as a flow balance controlling mechanism.

Heat Capacity Sensing System

As one embodiment of a sensing means for sensing the difference between the total heat-emitting capacity of the condenser (i.e., the outside heat-exchanger 70) and the total heat-absorbing capacity of the evaporator (i.e., the inside heat-exchanger 71) or the ratio of the former to the latter, as shown in FIG. 2, the pressure sensor 390 for sensing high pressure is provided in the refrigerant circulation line on the high pressure side between the compressors A and B and the expansion valve 76. The pressure detected by the pressure sensor 390 for high pressure can be determined in such a way that the lower the detected pressure, the greater the difference between the total heat-emitting capacity and the total heat-absorbing capacity (or the ratio of the former to the latter) has become.

As another embodiment of a sensing means for sensing the difference between the total heat-emitting capacity and the total heat-absorbing capacity or the ratio of the former to the latter, as shown in FIG. 9, the pressure sensor 305 for sensing high pressure (when in the cooling mode) is provided in the refrigerant circulation line on the high pressure side near the expansion valve 76 and between the compressors A and B and the expansion valve 76. The pressure detected by the pressure sensor 305 for high pressure can be determined in such a way that the lower the detected pressure, the greater the difference between the total heat-emitting capacity and the total heat-absorbing capacity (or the ratio of the former to the latter) has become.

Further, in the embodiment shown in FIG. 9, the pressure sensor 306 for sensing low pressure (when in the cooling mode) is provided in the line downstream of the expansion valve 76. The pressure detected by the pressure sensor 306 for low pressure can be determined in combination with the pressure detected by the pressure sensor 305 for high pressure in such a way that the smaller the difference between the high pressure and the low pressure, the greater the difference between the total heat-emitting capacity and the total heat-absorbing capacity (or the ratio of the former to the latter) has become.

In the embodiment shown in FIG. 2, a temperature sensor 400 is provided to detect the outside temperature. The temperature detected by the temperature sensor 400 can be determined in such a way that the lower the detected temperature, the greater the difference between the total heat-emitting capacity and the total heat-absorbing capacity (or the ratio of the former to the latter) has become.

In the embodiment shown in FIG. 2, a temperature sensor 402 for sensing the temperature of the refrigerant upstream of the condenser (inside heat-exchanger 70), in addition to the temperature sensor 400 are provided. The difference between the temperature detected by the temperature sensor 402 and the temperature detected by the temperature sensor 400 can be determined in such a way that the higher the difference in the detected temperature, the greater the difference between the total heat-emitting capacity and the total heat-absorbing capacity (or the ratio of the former to the latter) has become. In addition, as shown in FIG. 10, the temperature sensor 402*a* for sensing the refrigerant immediately upstream of the outside heat-exchanger 70 or the temperature sensor 402*c* for sensing the refrigerant passing through the outside heat-exchanger 70 can be provided, and the difference between the temperature detected by the temperature sensor 402*a* or 402*c* and the temperature detected by the temperature sensor 400 can be determined in such a way that the higher the difference in the detected temperature, the greater the difference between the total heat-emitting capacity and the total heat-absorbing capacity (or the ratio of the former to the latter) has become.

In addition, when a sensor for sensing the number of operating inside heat-exchangers is provided, the difference between the total heat-absorbing capacity of the evaporator and the total heat-emitting capacity of the condenser (or the ratio of the former to the latter) can be determined in such a way that the lower the number of operating inside heat-exchangers, the greater the difference in capacity (or the ratio) becomes. Further, when a temperature sensor for sensing the room temperature is provided, the difference between the total heat-absorbing capacity of the evaporator and the total heat-emitting capacity of the condenser (or the ratio of the former to the latter) can be determined in such a way that the greater the difference between the operator's desired temperature and the sensed room's temperature, the greater the difference in capacity (or the ratio) becomes.

As shown in FIGS. 2 and 9, when the temperature sensor 400 for sensing the outside temperature and the pressure sensor 305 for sensing the pressure in the refrigerant circulation line on the high pressure side, i.e., the line from the compressors A and B to the expansion valve 76 via the outside heat-exchanger 70 (condenser) are provided, the higher the outside temperature, the higher the target high pressure is selected, wherein the target high pressure is higher than the detected pressures. The high pressure detected by the pressure sensor 305 can be determined in such a way that the greater the difference between the detected pressure and the target pressure, the greater the difference between the total heat-emitting capacity and the total heat-absorbing capacity (or the ratio of the former to the latter) has become.

Figure 19:
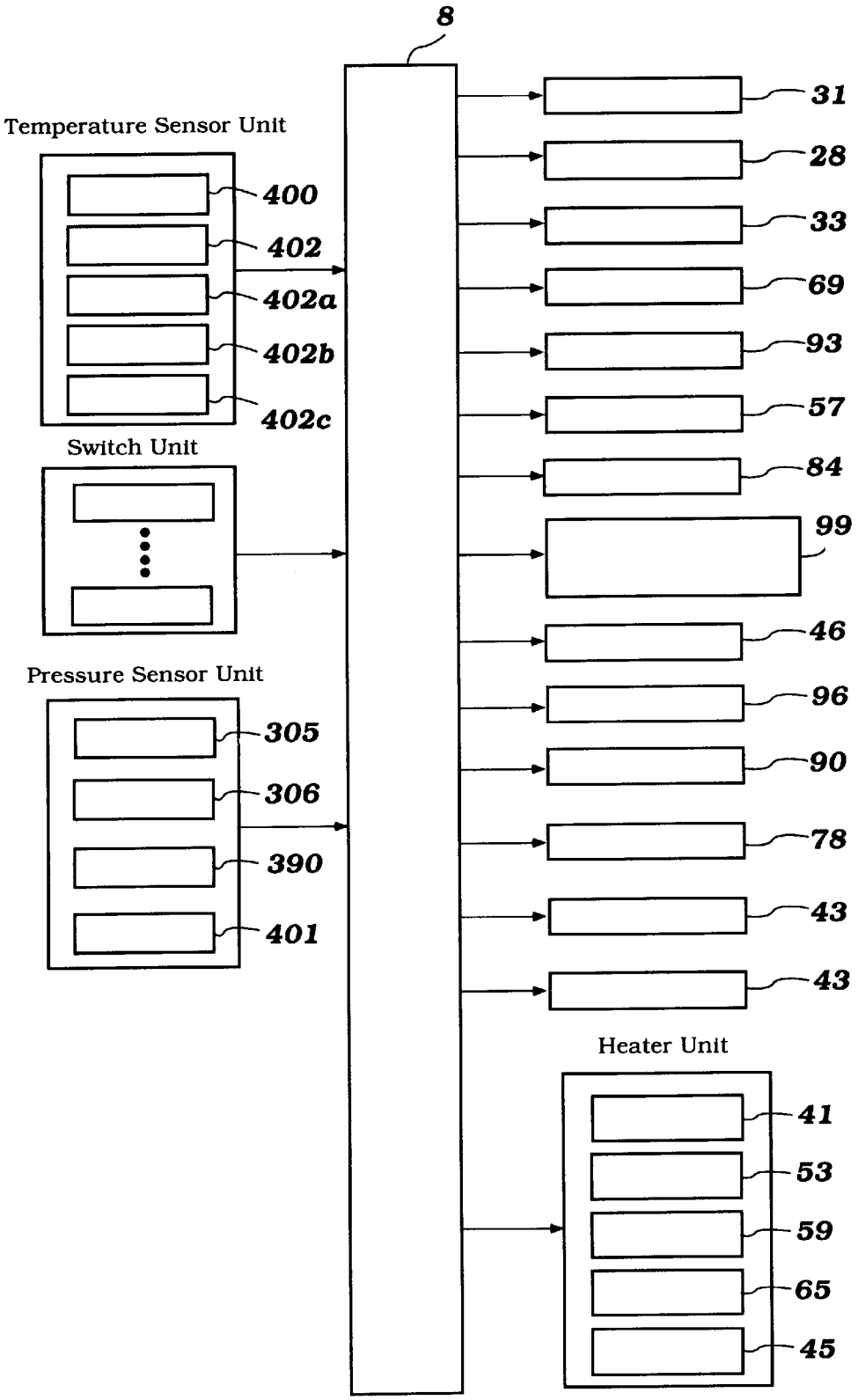
FIG. 19 is a schematic block chart showing a control system of an embodiment of the present invention, comprising a switch group, a temperature sensor group, a pressure sensor group, a control group, a heater group, and an actuator group.

FIG. 19 is a schematic block chart showing the sensing system group, the control system unit, and the output system group.

In the present invention, each energy-supplying mechanism described above can be employed singly or in combination of two or more to achieve the objective of the present invention, i.e., compensation for insufficient total heat-absorbing capacity to stabilize heat pumping operation.

Further, this invention can be adapted to compensation for insufficient total heat-absorbing capacity when in the heating mode, e.g., when the outside temperature is very cold. In the heating mode, the inside heat-exchanger functions as a condenser, and the outside heat-exchanger functions as an evaporator.

Heat Capacity Balancing Operation

As described above, a heat pump system of the present invention is provided with an energy compensation system and/or a refrigerant flow control system which allows for stable cooling, heating, or freezing operation by compensating for insufficient total heat-absorbing capacity, especially when condensation capacity increases due to, for example, a cold or windy environment. The above goal can be achieved by fulfilling at least one of the operations a–j described below corresponding to the following target conditions A–K:

A. When a temperature sensing means for detecting the outside temperature is provided, control is conducted in such a way that the lower the detected temperature, the higher the temperature becomes.

C. When a temperature sensing means for detecting the outside temperature and a pressure sensing means for detecting the pressure in the refrigerant circulation line on the high pressure side, i.e., the line from the compressor to the expansion valve via the condenser (the outside heat-exchanger), are provided, the lower the detected temperature, the higher the target high pressure is selected, and control is conducted in such a way that the higher the difference between the target pressure and the detected pressure, the lower the difference in pressure becomes.

E. When an opening sensing means for detecting the opening of the evaporator and a pressure sensing means for detecting the pressure in the refrigerant circulation line on the high pressure side, i.e., the line from the compressor to the expansion valve via the condenser (the outside heat-exchanger), are provided, the smaller the opening of the evaporation valve, the higher the target high pressure is selected, and control is conducted in such a way that the higher the difference between the target pressure and the detected pressure, the lower the difference in pressure becomes.

F. When a pressure sensing means for detecting the pressure in the refrigerant circulation line on the high pressure side, i.e., the line from the compressor to the expansion valve via the condenser (the outside heat-exchanger), is provided, control is conducted in such a way that the lower the detected pressure, the higher the pressure becomes.

H. When pressure sensing means for detecting the pressure in the refrigerant circulation line upstream (high pressure) and downstream (low pressure) of the expansion valve are provided, the smaller the difference between the high pressure and the low pressure, the greater the difference in pressure becomes.

I. When a sensor for sensing the number of operating inside heat-exchangers is provided, the difference between the total heat-absorbing capacity of the evaporator and the total heat-emitting capacity of the condenser (or the ratio of the former to the latter) is determined in such a way that the lower the number of operating inside heat-exchangers, the greater the difference in capacity (or the ratio) becomes, and control is conducted to reduce the difference in capacity (or the ratio).

J. When a temperature sensor for sensing the room's temperature is provided, the difference between the total heat-absorbing capacity of the evaporator and the total heat-emitting capacity of the condenser (or the ratio of the former to the latter) is determined in such a way that the greater the difference between the operator's desired temperature and the sensed room temperature, the greater the difference in capacity (or the ratio) becomes, and control is conducted to reduce the difference in capacity (or the ratio).

K. When pressure-measuring means for measuring the pressure of the refrigerant in the line on the high pressure side downstream of the compressor and upstream of the expansion valve, as well as temperature-measuring means for measuring the temperature of the refrigerant between the condenser and the expansion valve, are provided, control is conducted in such a way that when the measured refrigerant temperature is higher than the temperature calculated from the measured refrigerant pressure on the high pressure side, the difference in temperature becomes zero or negative values.

Figure 17:
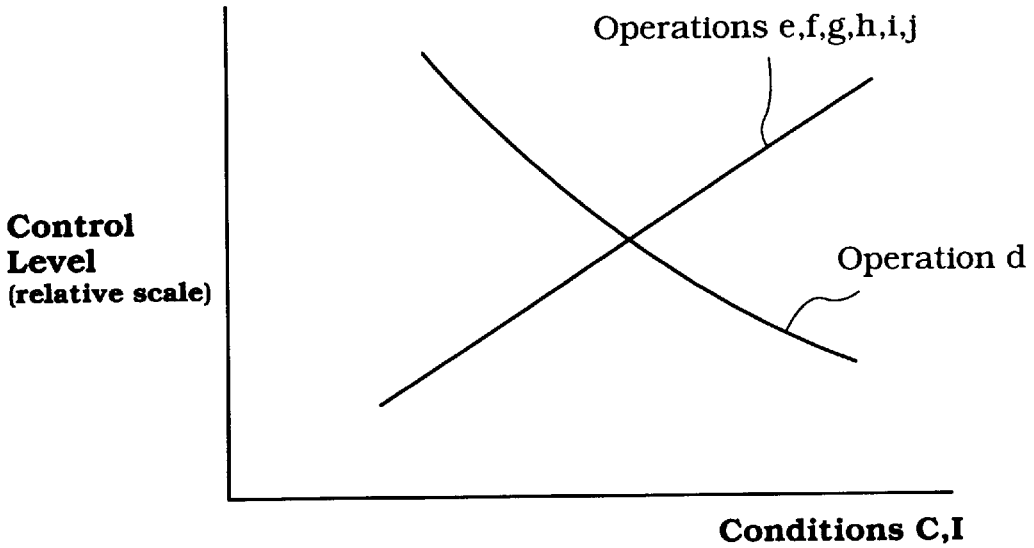
FIG. 17 is a schematic graph showing the conceptual relationship between the degree of control factors e–j and the degree of conditions C and I in an embodiment of the present invention.
Figure 18:
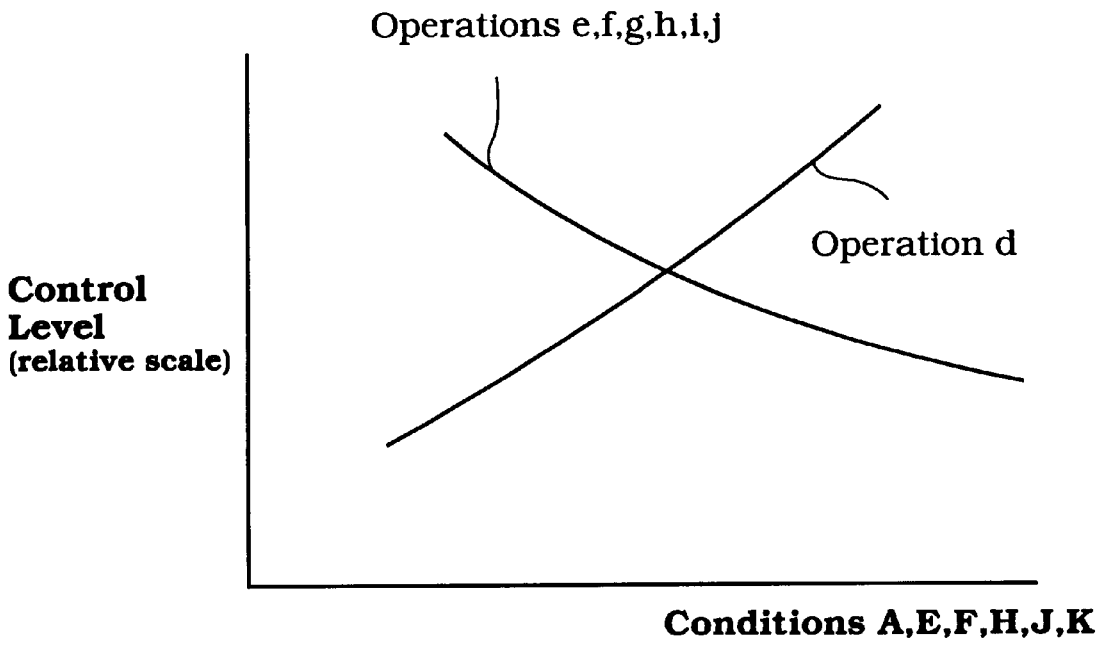
FIG. 18 is a schematic graph showing the conceptual relationship between the degree of control factors e–j and the degree of conditions A, E, F, H, J, and K in an embodiment of the present invention.

Operations to satisfy the above target conditions are as follows, and control can be achieved as shown in FIGS. 17 and 18:

d. Operation of a cooling fan for cooling the condenser (the outside heat-exchanger) is discontinued or slowed.

e. A bypass line, which bypasses the compressor and the condenser (the inside heat-exchanger) and communicates the refrigeration circulation line downstream of the evaporator (the inside heat-exchanger) and that downstream of the condenser (the outside heat-exchanger), and which is provided with a linearly controlled valve therein, is provided, and the opening of the valve is enlarged or full.

f. A bypass line, which bypasses the condenser (the outside heat-exchanger) and communicates the refrigeration circulation line upstream of the condenser (the outside heat-exchanger) and that downstream of the condenser (the outside heat-exchanger), and which is provided with a linearly controlled valve therein, is provided, and the opening of the valve is enlarged or full.

g. A bypass line, which bypasses the condenser (the outside heat-exchanger) and the expansion valve and communicates the refrigeration circulation line upstream of the condenser (the outside heat-exchanger) and that downstream of the expansion valve, and which is provided with a linearly controlled valve therein, is provided, and the opening of the valve is enlarged or full.

h. Heat exerted onto the refrigerant on the low pressure side is increased.

i. Heat exerted onto the refrigerant on the high pressure side is increased.

j. In above "h" or "i", heat from the engine cooling water is exerted onto the refrigerant.

k. Control is conducted by a combination of d–j.

It will be understood by those of skill in the art that numerous variations and modifications can be made without departing from the spirit of the present invention. Therefore, it should be clearly understood that the forms of the present invention are illustrative only and are not intended to limit the scope of the present invention.

We claim:

1. A heat pump system comprising a refrigerant circulation line in which a refrigerant circulates, said refrigerant circulation line comprising: a compressor for circulating said refrigerant; a condenser for exchanging heat between said refrigerant and the medium outside said condenser; an expansion valve; and an evaporator for exchanging heat between said refrigerant and the medium outside said evaporator, wherein said system further comprises: a heat capacity detection mechanism for detecting a signal indicative of a difference between the total heat-emitting capacity of said condenser and the total heat-absorbing capacity of said evaporator or a ratio of the total heat-emitting capacity of said condenser to the total heat-absorbing capacity of said evaporator; an energy-supplying mechanism for exerting energy onto said refrigerant based on the signal detected by the heat capacity detection mechanism; an accumulator for accumulating a liquid refrigerant provided downstream of said evaporator and upstream of said compressor; and refrigerant-heating means for heating the liquid refrigerant in said accumulator, wherein said energy-supplying mechanism is said refrigerant-heating means.

2. A heat pump system according to claim 1, wherein said energy-supplying mechanism is provided on the refrigerant circulation line on the high pressure side downstream of said compressor and upstream of said expansion valve via said condenser.

3. A heat pump system according to claim 1, further comprising: a water-cooling engine for driving said compressor; and a cooling water heat-exchanger for exchanging heat between the cooling water circulating therethrough, which has absorbed heat from said water-cooled engine, and the refrigerant circulating therethrough, wherein said energy-supplying mechanism is said cooling water heat-exchanger.

4. A heat pump system comprising a refrigerant circulation line in which a refrigerant circulates, said refrigerant circulation line comprising: a compressor for circulating said refrigerant; a condenser for exchanging heat between said refrigerant and the medium outside said condenser; an expansion valve; and an evaporator for exchanging heat between said refrigerant and the medium outside said evaporator, wherein said system further comprises: a heat capacity detection mechanism for detecting a signal indicative of a difference between the total heat-emitting capacity of said condenser and the total heat-absorbing capacity of said evaporator or a ratio of the total heat-emitting capacity of said condenser to the total heat-absorbing capacity of said evaporator; an energy-supplying mechanism for exerting energy onto said refrigerant based on the signal detected by the heat capacity detection mechanism; an accumulator upstream of said compressor and downstream of said evaporator; a water-cooled engine for driving said compressor; and a hot water circulation line for circulating water through said water-cooled engine and said accumulator, wherein said energy-supplying mechanism is an hot water heat-exchanger positioned in said accumulator, said hot water heat-exchanger exchanging heat between the hot water circulating therethrough and the refrigerant in said accumulator.

5. A heat pump system comprising a refrigerant circulation line in which a refrigerant circulates, said refrigerant circulation line comprising: a compressor for circulating said refrigerant; a condenser for exchanging heat between said refrigerant and the medium outside said condenser; an expansion valve; and an evaporator for exchanging heat between said refrigerant and the medium outside said evaporator, wherein said system further comprises: a heat capacity detection mechanism for detecting a signal indicative of a difference between the total heat-emitting capacity of said condenser and the total heat-absorbing capacity of said evaporator or a ratio of the total heat-emitting capacity of said condenser to the total heat-absorbing capacity of said evaporator; an energy-supplying mechanism for exerting energy onto said refrigerant based on the signal detected by the heat capacity detection mechanism; an accumulator upstream of said compressor and downstream of said evaporator; and an oil separator downstream of said compressor and upstream of said condenser, in which said accumulator and said oil separator are adjoined via a heat-exchange wall interposed therebetween to provide said energy-supplying mechanism, wherein heat is exchanged between the oil in said oil separator and the refrigerant in said accumulator.

6. A heat pump system comprising a refrigerant circulation line in which a refrigerant circulates, said refrigerant circulation line comprising: a compressor for circulating said refrigerant; a condenser for exchanging heat between said refrigerant and the medium outside said condenser; an expansion valve; and an evaporator for exchanging heat between said refrigerant and the medium outside said evaporator, wherein said system further comprises: a heat capacity detection mechanism for detecting a signal indicative of a difference between the total heat-emitting capacity of said condenser and the total heat-absorbing capacity of said evaporator or a ratio of the total heat-emitting capacity of said condenser to the total heat-absorbing capacity of said evaporator; an energy-supplying mechanism for exerting energy onto said refrigerant based on the signal detected by the heat capacity detection mechanism; a four-way valve for reversing the flow of said refrigerant at said condenser and at said evaporator to switch the operation mode between the heating mode and the cooling mode, said four-way valve being provided upstream of said compressor, wherein said condenser is an inside heat-exchanger when in the heating mode and is an outside heat-exchanger when in the cooling mode, and said evaporator is said inside heat-exchanger when in the cooling mode and is said outside heat-exchanger when in the heating mode, said energy-supplying mechanism being provided on the refrigerant circulation line on the refrigerant intake side from said four-way valve to said compressor; an accumulator for accumulating a liquid refrigerant provided downstream of said evaporator and upstream of said compressor; and refrigerant-heating means for heating the liquid refrigerant in said accumulator, wherein said energy-supplying mechanism is said refrigerant-heating means.

7. A heat pump system according to claim 6, further comprising: a water-cooling engine for driving said compressor; and a cooling water heat-exchanger for exchanging heat between the cooling water circulating therethrough, which has absorbed heat from said water-cooled engine, and the refrigerant circulating therethrough, wherein said energy-supplying mechanism is said cooling water heat-exchanger.

* * * * *